United States Patent [19]

Saitoh et al.

[11] Patent Number: 4,705,735

[45] Date of Patent: Nov. 10, 1987

[54] MEMBER HAVING SUBSTRATE WITH PROTRUDING SURFACE PORTIONS AND LIGHT RECEIVING LAYER WITH AMORPHOUS SILICON MATRIX

[75] Inventors: Keishi Saitoh, Ibaraki; Tetsuo Sueda, Chofu; Kyosuke Ogawa, Tokyo; Teruo Misumi, Kawasaki; Yoshio Tsuezuki, Toride; Masahiro Kanai, Tokyo, all of Japan

[73] Assignee: Canon Kabushiki Kaisha, Tokyo, Japan

[21] Appl. No.: 741,300

[22] Filed: Jun. 4, 1985

[30] Foreign Application Priority Data

| | | | |
|---|---|---|---|
| Jun. 7, 1984 | [JP] | Japan | 59-115603 |
| Jun. 8, 1984 | [JP] | Japan | 59-116628 |
| Jun. 11, 1984 | [JP] | Japan | 59-118096 |
| Jun. 12, 1984 | [JP] | Japan | 59-119091 |
| Jun. 13, 1984 | [JP] | Japan | 59-119749 |
| Jun. 14, 1984 | [JP] | Japan | 59-120839 |

[51] Int. Cl.[4] ..... G03G 5/085

[52] U.S. Cl. ..... 430/57; 430/63; 430/69; 430/84

[58] Field of Search ..... 430/56, 57, 58, 65, 430/69, 84, 127, 63

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Mimura et al. | 430/67 |
| 4,514,483 | 4/1985 | Matsuura et al. | 430/85 |
| 4,592,981 | 6/1986 | Saitoh et al. | 430/69 |
| 4,592,983 | 6/1986 | Saitoh et al. | 430/69 |
| 4,595,644 | 6/1986 | Saitoh et al. | 430/69 |
| 4,600,671 | 7/1986 | Saitoh et al. | 430/69 |

FOREIGN PATENT DOCUMENTS

| | | | |
|---|---|---|---|
| 2733187 | 1/1978 | Fed. Rep. of Germany | 430/65 |
| 56-50754 | 11/1981 | Japan | 430/65 |
| 60-31144 | 2/1985 | Japan | 430/69 |

*Primary Examiner*—John L. Goodrow

*Attorney, Agent, or Firm*—Fitzpatrick, Cella, Harper & Scinto

[57] ABSTRACT

A light-receiving member comprises a substrate having a large number of protruding portions on a surface thereof, each of said protruding portions having at a predetermined cut position a sectional shape comprising a main projection and a subprojection, the main projection and the subprojection overlapping each other, and a light-receiving layer of a multi-layer structure having a first layer comprising an amorphous material containing silicon atoms and germanium atoms, a second layer comprising an amorphous material containing silicon atoms and exhibiting photoconductivity and a surface layer having reflection preventive function provided on the substrate successively from the substrate side.

38 Claims, 57 Drawing Figures

MEMBER HAVING SUBSTRATE WITH PROTRUDING SURFACE PORTIONS AND LIGHT RECEIVING LAYER WITH AMORPHOUS SILICON MATRIX

CROSS-REFERENCE TO RELATED APPLICATIONS:

This application contains subject matter related to commonly assigned, copending application Ser. Nos. 697,141; 699,868; 705,516; 709,888; 720,011; 740,901; 786,970; 725,751; 726,768; 719,980; 739,867; 740,714; 741,300; 753,048; 752,920 and 753,011.

BACKGROUND OF THE INVENTION

1. Field of the invention

This invention relates to a light-receiving member having sensitivity to electromagnetic waves such as light [herein used in a broad sense, including ultraviolet rays, visible light, infrared rays, X-rays and gamma-rays]. More particularly, it pertains to a light receiving member suitable for using a coherent light such as laser beam.

2. Description of the prior art

As the method for recording a digital image information as an image, there have been well known the methods in which an electrostatic latent image is formed by scanning optically a light-receiving member with a laser beam modulated corresponding to a digital image information, then said latent image is developed, followed by processing such as transfer or fixing, if desired, to record an image. Among them, in the image forming method employing electrophotography, image recording has been generally practiced with the use of a small size and inexpensive He-Ne laser or a semiconductor laser (generally having an emitted wavelength of 650–820 nm).

In particular, as the light-receiving member for electrophotography which is suitable when using a semiconductor laser, an amorphous material containing silicon atoms (hereinafter written briefly as "A-Si") as disclosed in Japanese Laid-open patent application Nos. 86341/1979 and 83746/1981 is attracting attention for its high vickers hardness and non-polluting properties in social aspect in addition to the advantage of being by far superior in matching in its photosensitive region as compared with other kinds of light receiving members.

However, when the photosensitive layer is made of a single A-Si layer,for ensuring dark resistance of $10_{12}$ ohm.cm or higher required for electrophotography while maintaining high photosensitivity, it is necessary to incorporate structurally hydrogen atoms or halogen atoms or boron atoms in addition thereto in controlled form within specific ranges of amounts. Accordingly, control of layer formation is required to be performed severely, whereby tolerance in designing of a light-receiving member is considerably limited.

As attempts to enlarge this tolerance in designing, namely to enable effective utilization of its high photosensitivity in spite of somewhat lower dark resistance, there have been proposed a light receiving layer with a multi-layer structure of two or more laminated layers with different conductivity characteristics with formation of a depletion layer within the light-receiving layer, as disclosed in Japanese Laid-open patent application Nos. 121743/1979, 4053/1982 and 4172/1982, or a light-receiving member with a multi-layer structure in which a barrier layer is provided between the substrate and the photosensitive layer and/or on the upper surface of the photosensitive layer, thereby enhancing apparent dark resistance of the light receiving layer as a whole, as disclosed in Japanese Laid-open patent application Nos. 52178/1982, 52179/1982, 52180/1982, 58159/1982, 58160/1982 and 58161/1982.

According to such proposals, A-Si type light receiving members have been greatly advanced in tolerance in designing of commercialization thereof or easiness in management of its production and productivity, and the speed of development toward commercialization is now further accelerated.

When carrying out laser recording by use of such a light receiving member having a light receiving layer of a multi-layer structure, due to irregularity in thickness of respective layers, and also because of the laser beam which is an coherent monochromatic light, it is possible that the respective reflected lights reflected from the free surface on the laser irradiation side of the light receiving layer and the layer interface between the respective layers constituting the light receiving layer and between the substrate and the light receiving layer (hereinafter "interface" is used to mean comprehensively both the free surface and the layer interface) may undergo interference.

Such an interference phenomenon results in the so-called interference fringe pattern in the visible image formed and causes a poor iamge. In particular, in the case of forming a medium tone image with high gradation, bad appearance of the image will become marked.

Moreover, as the wavelength region of the semiconductor laser beam is shifted toward longer wavelength, absorption of said laser beam in the photosensitive layer becomes reduced, whereby the above interference phenomenon becomes more marked.

This point is explained by referring to the drawings.

FIG. 1 shows a light $I_0$ entering a certain layer constituting the light receiving layer of a light receiving member, a reflected light $R_1$ from the upper interface 102 and a reflected light $R_2$ reflected from the lower interface 101.

Now, the average layer thickness of the layeris defined as d, its refractive index as n and the wavelength of the light as $\lambda$, and when the layer thickness of a certain layer is ununiform gently with a layer thickness difference of $\lambda/2n$ or more, changes in absorbed light quantity and transmitted light quantity occur depending on to which condition of $2nd=m\lambda$ (m is an integer, reflected lights are strengthened with each other) and $2nd=(m+\frac{1}{2})\lambda$ (m is an integer, reflected lights are weakened with each other) the reflected lights $R_1$ and $R_2$ conform.

In the light receiving member of a multi-layer structure, the interference effect as shown in FIG. 1 occurs at each layer, and there ensues a synergistic deleterious influence through respective interferences as shown in FIG. 2. For this reason, the interference fringe corresponding to said interference fringe pattern appears on the visible image transferred and fixed on the transfer member to cause bad images.

As the method for cancelling such an inconvenience, it has been proposed to subject the surface of the substrate to diamond cutting to provide unevenness of ±500 Å–±10000 Å, thereby forming a light scattering surface (as disclosed in Japanese Laid-open patent application No. 162975/1983); to provide a light absorbing layer by subjecting the aluminum substrate surface to black Alumite treatment or dispersing carbon, color pigment or dye in a resin (as disclosed in Japanese Laid-open patent application No. 165845/1982); and to provide a light scattering reflection preventive layer on the substrate surface by subjecting the aluminum substrate surface to satin-like Alumite treatment or by providing a sandy fine unevenness by sand blast (as disclosed in Japanese Laid-open patent application No. 16554/1982).

However, according to these methods of the prior art, the interference fringe pattern appearing on the image could not completely be cancelled.

For example, because only a large number of unevenness with specific sized are formed on the substrate surface according to the first method, although prevention of appearance of interference fringe through light scattering is indeed effected, regular reflection light component yet exists. Therefore, in addition to remaining of the interference fringe by said regular reflection light, enlargement of irradiated spot occurs due to the light scattering effect on the surface of the substrate to be a cause for substantial lowering of resolution.

As for the second method, such a black Alumite treatment is not sufficinent for complete absorption, but reflected light from the substrate surface remains. Also, there are involved various inconveniences. For example, in providing a resin layer containing a color pigment dispersed therein, a phenomenon of degassing from the resin layer occurs during formation of the A-Si photosensitive layer to markedly lower the layer quality of the photosensitive layer formed, and the resin layer suffers from a damage by the plasma during formation of A-Si photosensitive layer to be deteriorated in its inherent absorbing function. Besides, worsening of the surface state deleteriously affects subsequent formation of the A-Si photosensitive layer.

In the case of the third method of irregularly roughening the substrate surface, as shown in FIG. 3, for example, the incident light $I_0$ is partly reflected from the surface of the light receiving layer 302 to become a reflected light $R_1$, with the remainder progressing internally through the light receiving layer 302 to become a transmitted light $I_1$. The transmitted light $I_1$ is partly scattered on the surface of the substrate 301 to become scattered lights $K_1$, $K_2$, $K_3 \ldots K_n$, with the remainder being regularly reflected to become a reflected light $R_2$, a part of which goes outside as an emitted light $R_3$. Thus, since the reflected light Rl and the emitted light $R_3$ which is an interferable component remain, it is not yet possible to extinguish the interference fringe pattern.

On the other hand, if diffusibility of the surface of the substrate 301 is increased in order to prevent multiple reflections within the light receiving layer 302 through prevention of interference, light will be diffused within the light receiving layer 302 to cause halation, whereby resolution is disadvantageously lowered.

Particularly, in a light receiving member of a multi-layer structure, as shown in FIG. 4, even if the surface of the substrate 401 may be irregularly roughened, the reflected light $R_2$ from the first layer 402, tne reflected light $R_1$ from the second layer 403 and tne regularly reflected light $R_3$ from the surface of the substrate 401 are interfered with each other to form an interference fringe pattern depending on the respective layer thicknesses of the light receiving member. Accordingly, in a light receiving member of a multi-layer structure, it was impossible to completely prevent appearance of interference fringes by irregularly roughening the surface of the substrate 401.

In the case of irregularly roughening the substrate surface according to the method such as sand blasting, etc., the roughness will vary so much from lot to lot, and there is also nonuniformity in roughness even in the same lot, and therefore production control could be done with inconvenience. In addition, relatively large projections with random distributions are frequently formed, hence causing local breakdown of the light receiving layer during charging treatment.

On the other hand, in the case of simply roughening the surface of the substrate 501 regularly, as shown in FIG. 5, since the light-receiving layer 502 is deposited along the uneven shape of the surface of the substrate 501, the slanted plane of the unevenness of the substrate 501 becomes parallel to the slanted plane of the unevenness of the light receiving layer 502.

Accordingly, for the incident light on that portion, $2nd_1 = m\lambda$ or $2nd_1 = (m+\frac{1}{2})\lambda$ holds, to make it a light portion or a dark portion. Also, in the light receiving layer as a whole, since there is nonuniformity in which the maximum difference among the layer thicknesses $d_1$, $d_2$, $d_3$ and $d_4$ of the light receiving layer is $\lambda/2n$ or more, there appears a light and dark fringe pattern.

Thus, it is impossible to completely extinguish the interference fringe pattern by only roughening regularly the surface of the substrate 501.

Also, in the case of depositing a light receiving layer of a multi-layer structure on the substrate, the surface of which is regularly roughened, in addition to the interference between the regularly reflected light from the substrate surface and the reflected light from the light receiving layer surface as explained for light receiving member of a single layer structure in FIG. 3, interferences by the reflected lights from the interfaces between the respective layers participate to make the extent of appearance of interferance fringe pattern more complicated than in the case of the light receiving member of a single layer structure.

SUMMARY OF THE INVENTION

An object of the present invention is to provide a novel light-receiving member sensitive to light, which has cancelled the drawbacks as described above.

Another object of the present invention is to provide a light-receiving member which is suitable for image formation by use of a coherent monochromatic light and also easy in production management.

Still another object of the present invention is to provide a light-receiving member which can cancel the interference fringe pattern appearing during image formation and appearance of speckles on reversal developing at the same time and completely.

Still another object of the prevent invention is to provide a light-receiving member which is high in dielectric strength and photosensitivity and excellent in electrophotographic characteristics.

It is also another object of the present invention to provide a light-receiving member, which can provide an image of high quality which is high in density, clear in halftone and high in resolution and is suitable for electrophotography.

Still another object of the present invention is to provide a light receiving member which is capable of reducing light reflection from the surface of the light-receiving member and utilizing incident light efficiently.

According to the present invention, there is provided a light receiving member comprising a substrate having a large number of protruding portions on a surface thereof, each of said protruding portions having at a predetermined cut position a sectional shape comprising a main projection and a subprojection, the main projection and the subprojection overlapping each other, and a light receiving layer of a multi-layer structure having a first layer comprising an amorphous material containing silicon atoms and germanium atoms, a second layer comprising an amorphous material containing silicon atoms and exhibiting photoconductivity and a surface layer having reflection preventive function provided on the substrate successively from the substrate side.

DESCRIPTION OF THE PREFERRED EMBODIMENTS

Referring now to the accompnaying drawings, the present invention is to be described in detail.

FIG. 6 is a schematic illustration for explanation of the basic principle of the present invention.

In the present invention, on a substrate (not shown) having a fine uneven shape smaller than the resolution required for the device, a light-receiving layer of a multi-layer constitution is provided along the uneven slanted plane, with the thickness of the second layer 602 being continuously changed from $d_5$ to $d_6$, as shown enlarged in a part of FIG. 6, and therefore the interface 603 and the interface 604 have respective gradients. Accordingly, the coherent light incident on this minute portion (short range region ) l [indicated schematically in FIG. 6 (C), and its enlarged view shown in FIG. 6 (A)] undergoes interference at said minute portion l to form a minute interference fringe pattern.

Figure 7A:
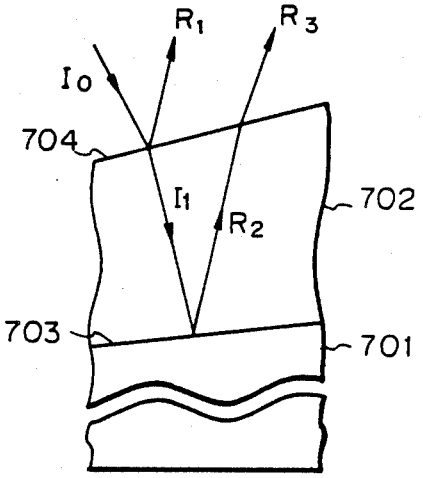
FIGS. 7(A), (B) and (C) are schematic illustration of comparison of the reflected light intensity between the case of parallel interfaces and non-parallel interfaces between the respective layers of a light-receiving member.
Figure 7B:
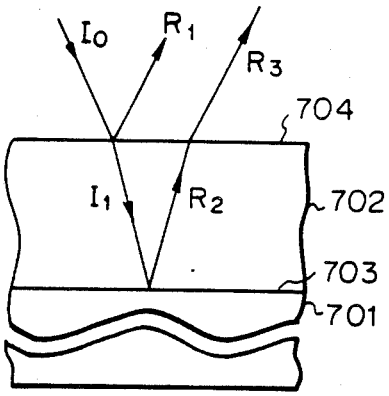
Figure 7C:
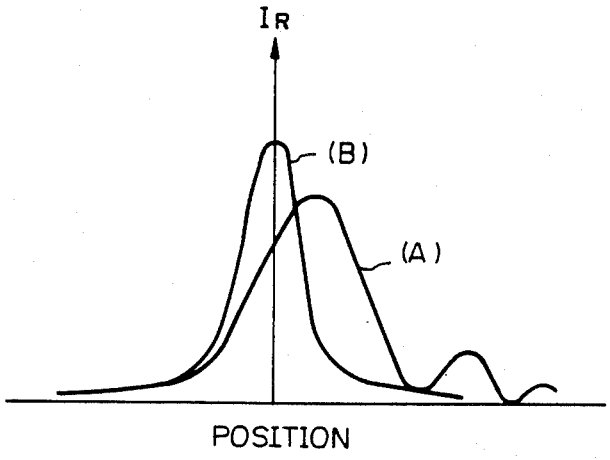
Figure 8:
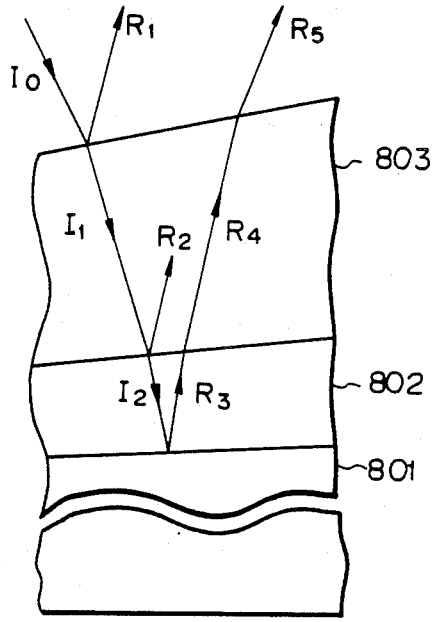
FIG. 8 is a schematic illustration of no appearance of interference fringe in the case of non-parallel interfaces between respective layer.

Also, as shown in FIG. 7, when the interface 703 between the first layer 701 and the second layer 702 and the free surface 704 are non-parallel to each other, the reflected light $R_1$ and the emitted light $R_3$ are different in direction of progress from each other relative to the incident light $I_0$ as shown in FIG. 7 (A), and therefore the degree of interrerence will be reduced as compared with the case (FIG. 7 (B)) when the interfaces 703 and 704 are parallel to each other.

Accordingly, as shown in FIG. 7 (C), as compared with the case "(B)" where a pair of the interfaces are in parallel relation, the difference in lightness and darkness in the interference fringe pattern becomes negligibly small even if interfered, if any, in the non-parallel case "(A)".

The same is the case, as shown in FIG. 6 even when the layer thickness of the layer 602 may be macroscopically ununiform ($d_7 \neq d_8$), and therefore the incident light quantity becomes uniform all over the layer region (see FIG. 6 (D)).

To describe about the effect of the present invention when coherent light is transmitted from the irradiation side to the first layer in the case of a light-receiving layer of a multi-layer structure, reflected lights $R_1$, $R_2$, $R_3$, $R_4$ and $R_5$ exist in connection with the incident light $I_0$. Accordingly, at the respective layers, the same phenomenon as described with reference to FIG. 7 occurs.

Moreover, the interfaces between the respective layers at a minute portion function as a kind of slit, at which diffraction phenomenon will occur.

Accordingly, interference at respective layers appears as the effect of the product of interference due to difference in layer thickness and the interference due to difraction at the respective layer interfaces.

Therefore, when considered for the light-receiving layer as a whole, interference occurs as a synergetic effect of the respective layers and, according to the present invention, appearance of interference can further be prevented as the number of layers constituting the light-receiving layer is increased.

The interference fringe occurring within the minute portion cannot appear on the image, because the size of the minute portion is smaller than the spot size of the irradiated light, namely smaller than the resolution limit. Further, even if appeared on the image, there is no problem at all, since it is less than resolving ability of the eyes.

In the present invention, the slanted plane of unevenness should desirably be mirror finished in order to direct the reflected light assuredly in one direction.

The size l (one cycle of uneven shape) of the minute portion suitable for the present invention is $l<L$, wherein L is the spot size of the irradiation light.

By such a designing, the diffraction effect at the ends of minute portions can positively be utilized, whereby appearance of interference fringe pattern can further be suppressed.

Further, in order to accomplish more effectively the objects of the present invention, the layer thickness difference ($d_{5-d6}$) at the minute portion l should desirably be as follows:

$d_5-d_6 > \lambda/2n$ (where $\lambda$ is the wavelength of the irradiation light and n is the refractive index or the second layer 602) (See FIG. 6).

In the present invention, within the layer thickness of the minute portion l (hereinafter called as "minute column") in the light-receiving layer of a multi-layer structure, the layer thicknesses of the respective layers are controlled so that at least two interfaces between layers may be in non-parallel relationship, and, provided that this condition is satisfied, any other pair of interfaces between layers may be in parallel relationship within said minute column.

However, it is desirable that the layers forming parallel interfaces should be formed to have uniform layer thicknesses so that the difference in layer thickness at any two positions may be not more than:

$\lambda/2n$ (n: refractive index of the layer).

For formation of the respective layers of the first layer and the second layer constituting the light-receiving layer, in order to accomplish more effectively and easily the objects of the present invention, the plasma chemical vapor deposition method (PCVD method), the optical CVD method and thermal CVD method can be employed, because the layer thickness can accurately be controlled on the optical level thereby.

As the method for working the substrate to accomplish the objects of the present invention, it is possible to utilize the chemical methods such as chemical etching, electric plating, etc., the physical methods such as vapor deposition, sputtering etc. and the mechanical methods such as lathe working, etc. However, the mechanical working method by lathe, etc. are preferred for easy production management. For example, a substrate may be worked with a lathe by fixing a bite having a V-shaped cutting blade at a predetermined position on a cutting working machine 5 such as milling machine, lathe, etc, and cut working accurately the substrate surface by, for example, moving regularly in a certain direction while rotating a cylindrical substrate according to a program previously designed as desired, thereby forming to a desired unevenness shape, pitch and depth. The linear projection produced by the unevenness formed by such a cutting working has a spiral structure with the center axis of the cylindrical substrate as its center. The spiral structure of the projection may be made into a multiple spiral structure such as double or triple structure or a crossed spiral structure.

Alternatively, a straight line structure along the center axis may also be introduced in addition to the spiral structure.

Each of the protruding portions within a sectional shape at a predetermined cut position of the substrate of the present invention is preferred to have the same shape as the first order approximation at a predetermined section in order to enhance the effect of the invention and make the working control easy.

At a predetermined cut position, each of the protruding portions has a sectional shape comprising a main projection (main peak) and a subprojection (subpeak), the main projection and the subprojection overlapping each other.

Figure 9A:
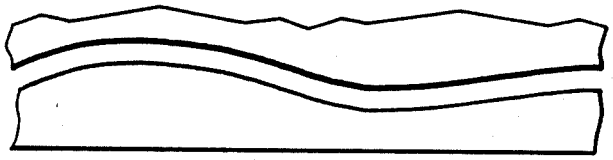
FIGS. 9(A) and (B) are schematic illustrations of the surface condition of typical substrates.
Figure 9B:
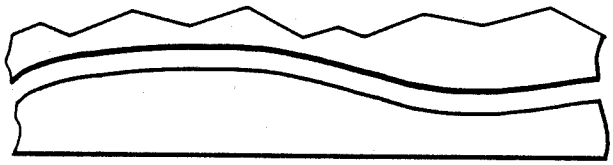

Preferably, the above-mentioned protruding portions may be arranged regularly or periodically in order to enhance the effect of the invention. Further, the above-mentioned protruding portion, for further enhancing the effect of the invention and enhancing adhesion between the light-receiving layer and the substrate, may preferably have multiple subprojections which may overlap each other. In addition to these, for scattering with good efficiency the incident light in one direction, the above-mentioned protruding portion may preferably be united in symmetrically [FIG. 9(A)] or asymmetrically [FIG. 9(B)] with the main projection at its center. However, for enhancing the degree of freedom in management of substrate working, it is preferred that both exist mixed in the substrate.

In the case of a substrate such as one which is cylindrical and has an axis of symmetry and on which protruding portions of spiral structure are provided with the axis of symmetry as its center, the term "a predetermined cut position of a substrate" in the present invention refers to any plane including the axis of symmetry. Further, in the case of a substrate such as planar one having a plane, the above term refers to any plane crossing at least two of a large number of protruding portions formed on the substrate.

In the present invention, the respective dimensions of the unevenness provided on the substrate surface under managed condition are set so as to accomplish effectively the objects of the present invention in view of the following points.

More specifically, in the first place, the A-Si layer constituting the light receiving layer is sensitive to the structure of the surface on which the layer formation is effected, and the layer quality will be changed greatly depending on the surface condition.

Accordingly, it is desirable to set dimensions of the unevenness to be provided on the substrate surface so that lowering in layer quality of the A-Si layer may not be brought about.

Secondly, when there is extreme unevenness on the free surface of the light-receiving layer, cleaning cannot frequently be performed completely in cleaning step after image formation.

Further, in case of practicing blade cleaning, there is involved the problem that the blade will be damaged more earlier.

As the result of investigations of the problems is layer deposition as described above, problems in process of electrophotography and the conditions for prevention of interference fringe pattern, it has been found that the pitch at the recessed portion on the substrate surface should preferably be 500 μm to 0.3 μm, more preferably 200 μm to 1 μm, most preferably 50 μm to 5 μm.

It is also desirable that the maximum depth of the recessed portion should preferably be made 0.1 μm to 5 μm, more preferably 0.3 μm, most preferably 0.6 μm to 2 μm. When the pitch and the maximum depth of the recessed portions on the substrate surface are within the ranges as specified above, the gradient of the slanted plane at the recessed portion (or linear projection) may preferably be 1° to 20°, more preferably 3° to 15°, most preferably 4° to 10°.

On the other hand, the maximum of the difference in the layer thickness based on such an uniformness in layer thickness of the respective layers formed on such a substrate should preferably be made 0.1 μm to 2 μm within the same pitch, more preferably 0.1 μm to 1.5 μm, most preferably 0.2 μm to 1 μm.

The thickness of the surface layer having reflection preventive function should preferably be determined as follows in order to exhibit fully its reflection preventive function.

When the refractive index of the material for the surface layer is defined as n and the wavelength of the light irradiated is as λ, the thickness of the surface layer having reflection preventive function may preferably be:

$$d = \frac{\lambda}{4n} m \text{ (} \underline{m} \text{ is an odd number).}$$

Also, as the material for the surface layer, when the second layer on which the surface layer is to be deposited is defined as $n_a$, a material having the following refractive index is most preferred:

$$n = \sqrt{n_a}.$$

By taking such optical conditions into considerations. the layer thickness of the reflection preventive layer may preferably be 0.05 to 2 μm, provided that the wavelength of the light for exposure is within the wavelength region of from near infrared light to visible light.

In the present invention, the material to be effectively used as having reflection preventive function may include, for example, inorganic fluorides, inorganic oxides or inorganic.nitrides such as $MgF_2$. $Al_2O_3$, $ZrO_2$, $TiO_2$, ZnS, $CeO_2$, $CeF_2$, $SiO_2$, SiO, $Ta_2O_5$, $AlF_3$, NaF, $Si_3N_4$ and the like or organic compounds such as polyvinyl chloride, polyamide resin, polyimide resin, vinylidene fluoride, melamine resin, epoxy resin, phenol resin, cellulose acetate and others.

These materials can be formed into the surface layer according to the vapor deposition method, the sputtering method, the plasma chemical vapor deposition method (PCVD), the optical CVD method. the thermal CVD method and the coating method, since the layer thickness can be controlled accurately at optical level in order to accomplish the objects of the present invention more effectively.

Further, the light-receiving layer in the light-receiving member of the present invention has a multi-layer structure comprising a first layer constituted of an amorphous material containing silicon atoms and germanium atoms and a second layer constituted of an amorphous material containing silicon atoms and exhibiting photoconductivity provided on a substrate successively from the substrate side, and therefore can exhibit very excellent electrical, optical and photoconductive characteristics, dielectric strength as well as good use environmental characteristics.

In particular, when it is applied as a light-receiving member for electrophotography, there is no influence of residual potential on image formation at all, with its electrical properties being stable with high sensitivity and high SN ratio, also excellent in light fatigue resistance and repeated use characteristics, whereby it is possible to obtain repeatedly and stably images of high quality with high density, clear halftone and high resolution.

Further, the light-receiving member of the present invention is high in photosensitivity over the all visible light regions, particularly in photosensitivity to the light of longer wavelength region and is therefore excellent in matching to semiconductor laser and also rapid in light response.

Referring now the drawings, the light-receiving member of the present invention is to be described in detail.

Figure 10:
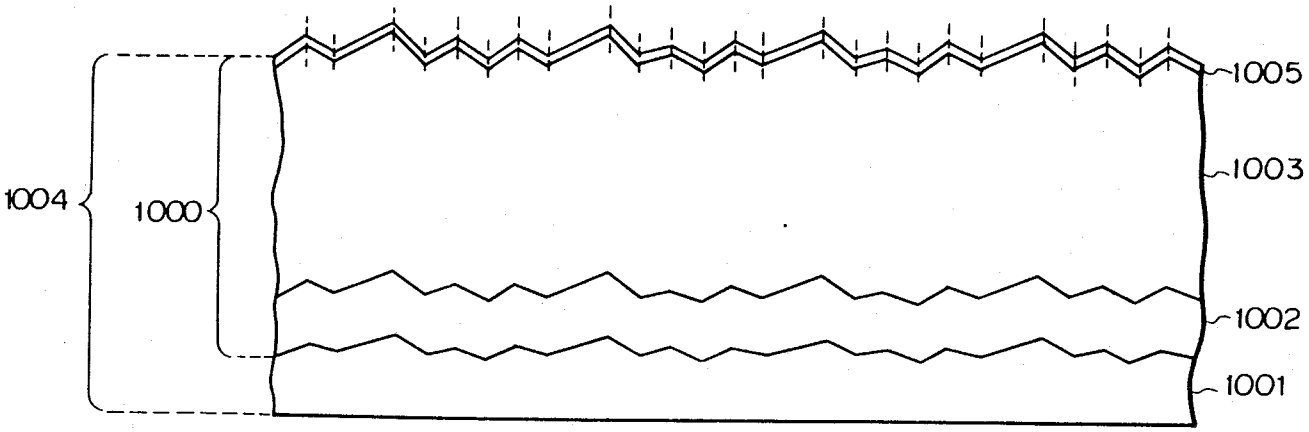
FIG. 10 is a schematic illustration of the layer constitution of a light-receiving member.

FIG. 10 is a schematic illustration of construction for explanation of the layer constitution of the light receiving member according to an embodiment of the present invention.

The light receiving member shown in FIG. 10 has a light receiving layer 1000 on a substrate 1001 for light receiving member 1004, the light receiving member having a free surface 1005 on one end surface thereof.

The light receiving layer has a layer structure, having a first layer (G) 1002 constituted of an amorphous material containing silicon atoms and germanium atoms, optionally together with hydrogen atoms and/or halogen atoms (X) (hereinafter abbreviated as A-SiGe(H,X), a second layer (S) 1003 constituted of A-Si optionally containing hydrogen atoms and/or halogen atoms (X) (hereinafter abbreviated as "A-Si(H,X)") and having photoconductivity and a surface layer 1006 having reflection preventive function laminated successively from the substrate 1001 side.

The germanium atoms contained in the first layer (G) 1002 may be contained so that the distribution state may be uniform within the first layer (G), or they can be contained continuously in the layer thickness direction in said first layer (G) 1002, being more enriched at the substrate 1001 side toward the side opposite to the side where said substrate 1001 is provided (the surface 1005 side of the light-receiving layer 1001).

When the distribution state of the germanium atoms contained in the first layer (G) is ununiform in the layer thickness direction, it is desirable that the distribution state should be made uniform in the interplanar direction in parallel to the surface of the substrate.

In the present invention, in the second layer (S) provided on the first layer (G), no germanium atoms is contained and by forming a light-receiving layer to such a layer structure, the light-receiving member obtained can be excellent in photosensitivity to the light with wavelengths of all the regions from relatively shorter wavelength to relatively longer wavelength, including visible light region.

Also, when the distribution state of germanium atoms in the first layer (G) is ununiform in the layer thickness direction, the germanium atoms are distributed continuously throughout the whole layer region while giving a change in distribution concentration C of the germanium atoms in the layer thickness direction which is decreased from the substrate toward the second layer (S), and therefore affinity between the first layer (G) and the second layer (S) is excellent. Also, as described as hereinafter, by extremely increasing the distribution concentration C of germanium atoms at the end portion on the substrate side extremely great, the light on the longer wavelength side which cannot substantially be absorbed by the second layer (S) can be absorbed in the first layer (G) substantially completely, when employing a semiconductor laser, whereby interference by reflection from the substrate surface can be prevented.

Also, in the light-receiving member of the present invention, the respective amorphous materials constituting the first layer (G) and the second layer (S) have the common constituent of silicon atoms, and therefore chemical stability can sufficiently be ensured at the laminated interface.

FIGS. 11 through 19 show typical examples of distribution in the layer thickness direction of germanium atoms contained in the first layer region (G) of the light-receiving member in the present invention.

In FIGS. 11 through 19, the abscissa indicates the content C of germanium atoms and the ordinate the layer thickness of the first layer (G), $t_B$ showing the position of the end surface of the first layer (G) on the substrate side and $t_T$ the position of the end surface of the first layer (G) on the side opposite to the substrate side. That is, layer formation of the first layer (G) containing germanium atoms proceeds from the $t_B$ side toward the $t_T$ side.

Figure 11:
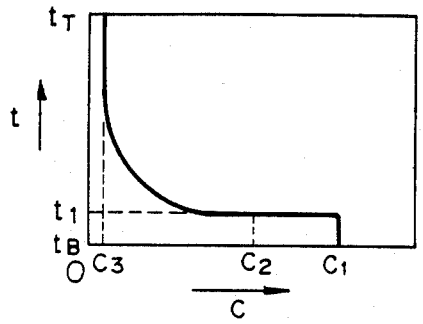
FIGS. 11 through 19 are schematic illustrations of the distribution states of germanium atoms in the first layer.

In FIG. 11, there is shown a first typical embodiment of the depth profile of germanium atoms in the layer thickness direction contained in the first layer (G).

In the embodiment as shown in FIG. 11, from the interface position $t_B$ at which the surface, on which the first layer (G) containing germanium atoms is to be formed, comes into contact with the surface of said first layer (G) to the position $t_1$, germanium atoms are contained in the first layer (G) formed, while the distribution concentration C of germanium atoms taking a constant value of $C_1$, the concentration being gradually decreased from the concentration $C_2$ continuously from the position $t_1$ to the interface position $t_T$. At the interface position $t_T$, the distribution concentration C of germanium atoms is made $C_3$.

Figure 12:
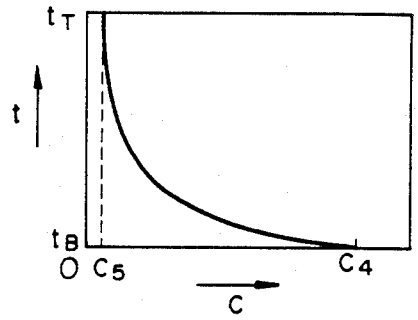

In the embodiment shown in FIG. 12, the distribution concentration C of germanium atoms contained is decreased gradually and continuously from the position $t_B$ to the position $t_T$ from the concentration $C_4$ until it becomes the concentration $C_5$ at the position $t_T$.

Figure 13:
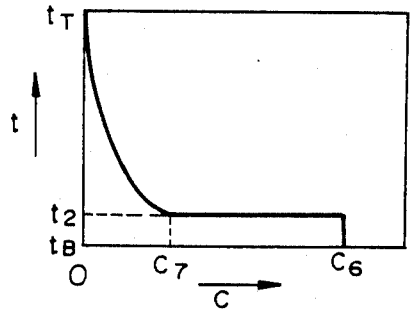

In case of FIG. 13, the distribution concentration C of germanium atoms is made constant as $C_6$ at the position $t_B$, gradually decreased continuously from the position $t_2$ to the position $t_T$, and the concentration C is made substantially zero at the position $t_T$ (substantially zero herein means the content less than the detectable limit).

Figure 14:
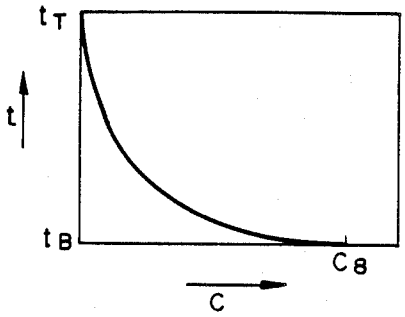

In case of FIG. 14, germanium atoms are decreased gradually and continuously from the position $t_B$ to the position $t_T$ from the concentration $C_8$, until it is made substantially zero at the position $t_T$.

Figure 15:
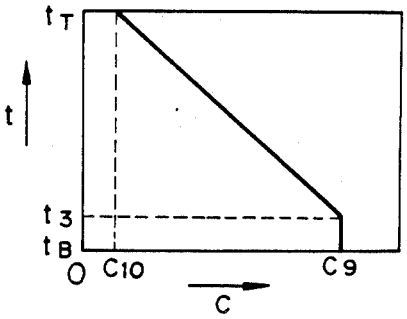

In the embodiment shown in FIG. 15, the distribution concentration C of germanium atoms is constantly $C_9$ between the position $t_B$ and the position $t_3$, and it is made $C_{10}$ at the position $t_T$. Between the position $t_3$ and the position $t_T$, the concentration C is decreased as a first order function from the position $t_3$ to the position $t_T$.

Figure 16:
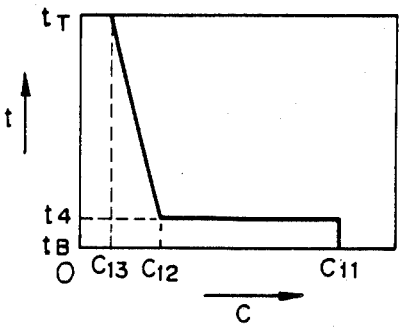

In the embodiment shown in FIG. 16, there is formed a depth profile such that the distribution concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 17:
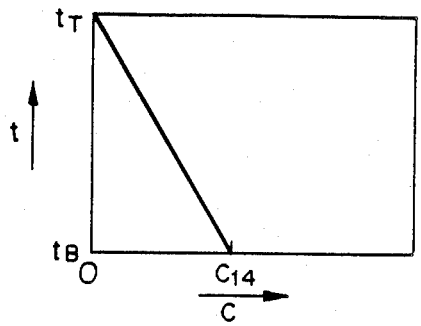

In the embodiment shown in FIG. 17, the distribution concentration C of germanium atoms is decreased as a first order function from the concentration $C_{14}$ to zero from the position $t_B$ to the position $t_T$.

Figure 18:
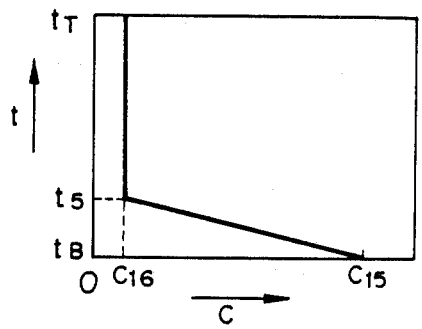

In FIG. 18, there is shown an embodiment, where the distribution concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 19:
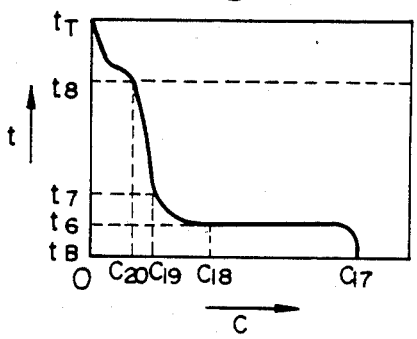

In the embodiment shown in FIG. 19, the distribution concentration C of germanium atoms is at the concentration $C_{17}$ at the position $t_B$, which concentration $C_{17}$ is initially decreased gradually and abruptly near the position $t_6$ to the position $t_6$, until it is made the concentration $C_{18}$ at the position $t_6$.

Between the position $t_6$ and the position $t_7$, the concentration is initially decreased abruptly and thereafter gradually, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of depth profiles of germanium atoms contained in the first layer (G) in the direction of the layer thickness by referring to FIGS. 11 through 19, when the distribution state of germanium atoms is ununiform in the layer thickness direction, the first layer (G) is provided desirably in a depth profile so as to have a portion enriched in distribution concentration C of germanium atoms on the substrate side and a portion depleted in distribution concentration C of germanium atoms considerably lower than that of the substrate side on the interface $t_T$ side.

The first layer (G) constituting the light-receiving member in the present invention is desired to have a localized region (A) containing germanium atoms at a relatively higher concentration on the substrate side as described above.

In the present invention, the localized region (A), as explained in terms of the symbols shown in FIG. 11 through FIG. 19, may be desirably provided within 5 $\mu$ from the interface position $t_B$.

In the present invention, the above localized region (A) may be made to be identical with the whole of the layer region ($L_T$) on the interface position $t_B$ to the thickness of 5 $\mu$, or alternatively a part of the layer region ($L_T$).

It may suitably be determined depending on the characteristics required for the light-receiving layer to be formed, whether the localized region (A) is made a part or whole of the layer region ($L_T$).

The localized region (A) may preferably be formed according to such a layer formation that the maximum value Cmax of the concentrations of germanium atoms in a distribution in the layer thickness direction may preferably be 1000 atomic ppm or more, more preferably 5000 atomic ppm or more, most preferably $1\times10^4$ atomic ppm or more based on silicon atoms.

That is, according to the present invention, it is desirable that the layer region (G) containing germanium atoms is formed so that the maximum value Cmax of the distribution concentration C may exist within a layer thickness of 5 $\mu$ from the substrate side (the layer region within 5 $\mu$ thickness from $t_B$).

In the present invention, the content of germanium atoms in the first layer (G), which may suitably be determined as desired so as to acheive effectively the objects of the present invention, may preferably be 1 to $9.5\times10^5$ atomic ppm, more preferably 100 to $8\times10^5$ atomic ppm, most preferably 500 to $7\times10^5$ atomic ppm.

In the present invention, the layer thickness of the first layer (G) and the thickness of the second layer (S)

are one of the important factors for accomplishing effectively the objects of the present invention, and therefore sufficient care should desirably be paid in designing of the light-receiving member so that desirable characteristics may be imparted to the light-receiving member formed.

In the present invention, the layer thickness $T_B$ of the first layer (G) may preferably be 30Åto 50 μ, more preferably 40Åto 40 μ, most preferably 50Åto 30 μ.

On the other hand, the layer thickness T of the second layer (S) may be preferably 0.5 to 90 μ, more preferably 1 to 80 μ, most preferably 2 to 50 μ.

The sum of the above layer thicknesses T and $T_B$, namely $(T+T_B)$ may be suitably determined as desired in designing of the layers of the light-receiving member, based on the mutual organic relationship between the characteristics required for both layer regions and the characteristics required for the whole light-receiving layer.

In the light-receiving member of the present invention, the numerical range for the above $(T_B+T)$ may generally be from 1 to 100 μ, preferably 1 to 80 μ, most preferably 2 to 50 μ.

In a more preferred embodiment of the present invention, it is preferred to select the numerical values for respective thicknesses $T_B$ and T as mentioned above so that the relation of $T_B/T<1$ may be satisfied.

In selection of the numerical values for the thicknesses $T_B$ and T in the above case, the values of $T_B$ and T should preferably be determined so that the relation $T_B/T<0.9$, most preferably, $T_B/T<0.8$, may be satisfied.

In the present invention, when the content of germanium atoms in the first layer (G) is $1\times10^5$ atomic ppm or more, the layer thickness $T_B$ should desirably be made considerably thinner, preferably 30 μ or less, more preferably 25 μ or less, most preferably 20 μ or less.

In the present invention, illustrative of halogen atoms (X), which may optionally be incorporated in the first layer (G) and the second layer (S) constituting the light-receiving layer, are fluorine, chlorine, bormine and iodine, particularly preferably fluorine and chlorine.

In the present invention, formation of the first layer (G) constituted of A-SiGe(H,X) may be conducted according to the vacuum deposition method utilizing discharging phenomenon, such as glow discharge method, sputtering method or ion-plating method. For example, for formation of the first layer (G) constituted of A-SiGe(H,X) according to the glow discharge method, the basic procedure comprises introducing a starting gas for Si supply capable of supplying silicon atoms (Si), a starting gas for Ge supply capable of supplying germanium atoms (Ge) optionally together with a starting gas for introduction of hydrogen atoms (H) and/or a starting gas for introduction of halogen atoms (X) into a deposition chamber which can be internally brought to a reduced pressure, and exciting glow discharge in said deposition chamber, thereby effecting layer formation on the surface of a substrate placed at a predetermined position while controlling the depth profile of germanium atoms according to a desired rate of change curve to form a layer constituent of A-SiGe (H,X). Alternatively, for formation according to the sputtering method, when carrying out sputtering by use of two sheets of targets of a target constituted of Si and a target constituted of Ge, or a target of a mixture of Si and Ge in an atmosphere of an inert gas such as Ar, He, etc. or a gas mixture based on these gases, a gas for introduction of hydrogen atpms (H) and/or a gas for introduction of halogen atoms (X) may be introduced, if desired, into a deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred because of easiness in handling during layer formation and high efficiency for supplying Si.

As the substances which can be used as the starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred because of easiness in handling during layer formation and high efficiency for supplying Ge.

Effective starting gases for introduction of halogen atoms to be used in the present invention may include a large number of halogenic compounds, as exemplified preferably by halogenic gases, halides, interhalogen compounds, or gaseous or gasifiable halogenic compounds such as silane derivatives substituted with halogens.

Further, there may also be included gaseous or gasifiable hydrogenated silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the light-receiving member of the present invention is formed according to the glow discharge method by employment of such a silicon compound containing halogen atoms, it is possible to form the first layer (G) constituted of A-SiGe containing halogen atoms on a desired substrate without use of a hydrogenated silicon gas as the starting gas capable of supplying Si together with the starting gas for Ge supply.

In the case of forming the first layer (G) containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio into the deposition chamber for formation of the first layer (G) and exciting glow discharge to form a plasma atmosphere of these gases, whereby the first layer (G) can be formed on a desired substrate. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

For formation of the first layer (G) comprising A-SiGe(H,X) according to the reactive sputtering method or the ion plating method, for example, in the case of the sputtering method, two sheets of a target of Si and a target of Ge or a target of Si and Ge is employed and subjected to sputtering in a desired gas plasma atmosphere. In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms, the halides or halo-containing silicon compounds as mentioned above can effectively be used. Otherwise, it is also possible to use effectively as the starting material for formation of the first layer (G) gaseous or gasifiable substances, including halides containing hydrogen atom as one of the constituents, e.g. hydrogen halide such as HF, HCl, HBr, HI, etc.; halo-substituted hydrogenated silicon such as $SiH_2F_2$, $SiH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing halogen atoms can preferably be used as the starting material for introduction of halogens, because hydrogen atoms, which are very effective for controlling electrical or photoelectric characteristics, can be introduced into the layer simultaneously with introduction of halogen atoms during formation of the first layer (G).

For introducing hydrogen atoms structurally into the first layer (G), other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H+X) to be contained in the first layer (G) constituting the light-receiving layer to be formed should preferably be 0.01 to 40 atomic %, more preferably 0.05 to 30 atomic %, most preferably 0.1 to 25 atomic %.

For controlling the amount of hydrogen atoms (H) and/or halogen atoms (X) to be contained in the first layer (G), for example, the substrate temperature and/or the amount of the starting materials used for incorporation of hydrogen atoms (H) or halogen atoms (X) to be introduced into the deposition device system, discharging power, etc. may be controlled.

In the present invention, for formation of the second layer (S) constituted of A-Si(H,X), the starting materials (I) for formation of the first layer (G), from which the starting materials for the starting gas for supplying Ge are omitted, are used as the starting materials (II) for formation of the second layer (S), and layer formation can be effected following the same procedure and conditions as in formation of the first layer (G).

More specifically, in the present invention, formation of the second layer region (S) constituted of a-Si(H,X) may be carried out according to the vacuum deposition method utilizing discharging phenomenon such as the glow discharge method, the sputtering method or the ion-plating method. For example, for formation of the second layer (S) constituted of A-Si(H,X) according to the glow discharge method, the basic procedure comprises introducing a starting gas for Si supply capable of supplying silicon atoms (Si) as described above, optionally together with starting gases for introduction of hydrogen atoms (H) and/or halogen atoms (X), into a deposition chamber which can be brought internally to a reduced pressure and exciting glow discharge in said deposition chamber, thereby forming a layer comprising A-Si(H,X) on a desired substrate placed at a predetermined position. Alternatively, for formation according to the sputtering method, gases for introduction of hydrogen atoms (H) and/or halogen atoms (X) may be introduced into a deposition chamber when effecting sputtering of a target constituted of Si in an inert gas such as Ar, He, etc. or a gas mixture based on these gases.

In the present invention, the amount of hydrogen atoms (H) or the amount of halogen atoms (X) or the sum of the amounts of hydrogen atoms and halogen atoms (H+X) to be contained in the second layer (S) constituting the light-receiving layer to be formed should preferably be 1 to 40 atomic %, more preferably 5 to 30 atomic %, most preferably 5 to 25 atomic %.

In the light-receiving member 1004, by incorporating a substance (C) for controlling conductivity in at least the first layer (G) 1002 and/or the second layer (S) 1003, desired conductivity characteristics can be given to the layer containing said substance (C).

In this case, the substance (C) for controlling conductivity may be contained throughout the whole layer region in the layer containing the substance (C) or contained locally in a part of the layer region of the layer containing the substance (C).

Also, in the layer region (PN) containing said substance (C), the distribution state of said substance (C) in the layer thickness direction may be either uniform or nonuniform, but desirably be made uniform within the plane in parallel to the substrate surface. When the distribution state of the substance (C) is nonuniform in the layer thickness direction, and when the substance (C) is to be incorporated in the whole layer region of the first layer (G), said substance (C) is contained in the first layer (G) so that it may be more enriched on the substrate side of the first layer (G).

Thus, in the layer region (PN), when the distribution concentration in the layer thickness direction of the above substance (C) is made nonuniform, optical and electrical junction at the contacted interface with other layers can further be improved.

In the present invention, when the substance (C) for controlling conductivity is incorporated in the first layer (G) so as to be locally present in a part of the layer region, the layer region (PN) in which the substance (C) is to be contained is provided as an end portion layer region of the first layer (G), which is to be determined case by case suitably as desired depending on.

In the present invention, when the above substance (C) is to be incorporated in the second layer (S), it is desirable to incorporate the substance (C) in the layer region including at least the contacted interface with the first layer (G).

When the substance (C) for controlling conductivity is to be incorporated in both the first layer (G) and the second layer (S), it is desirable that the layer region containing the substance (C) in the first layer (G) and the layer region containing the substance (C) in the second layer (S) may contact each other.

Also, the above substance (C) contained in the first layer (G) may be either the same as or different from that contained in the second layer (S), and their contents may be either the same or different.

However, in the present invention, when the above substance (C) is of the same kind in the both layers, it is preferred to make the content in the first layer (G) sufficiently greater, or alternatively to incorporate substances (C) with different electrical characteristics in respective layers desired.

In the present invention, by incorporating a substance (C) for controlling conductivity in at least the first layer (G) and/or the second layer (S) constituting the light-receiving layer, conductivity of the layer region containing the substance (C) [which may be either a part or the whole of the layer region of the first layer (G) and/or the second layer (S)] can be controlled as desired. As a substance (C) for controlling conductivity characteristics, there may be mentioned so called impurities in the field of semiconductors. In the present invention, there may be included p-type impurities giving p-type condutivity characteristics and n-type impurities and/or giving n-type conductivity characteristics to A-Si(H,X) and/or A-SiGe(H,X) constituting the light receiving layer to be formed.

More specifically, there may be mentioned as p-type impurities atoms belonging to the group III of the periodic table (Group III atoms), such as B (boron), Al(aluminum), Ga(gallium), In(indium), Tl(thallium), etc., particularly preferably B and Ga.

As n-type impurities, there may be included the atoms belonging to the group V of the periodic table, such as P (phosphorus), As (arsenic), Sb (antimony), Bi (bismuth), etc., particularly preferably P and As.

In the present invention, the content of the substance (C) for controlling conductivity in the layer region (PN) may be suitably be determined depending on the conductivity required for said layer region (PN), or when said layer region (PN) is provided in direct contact with the substrate, the organic relationships such as relation with the characteristics at the contacted interface with the substrate, etc.

Also, the content of the substance (C) for controlling conductivity is determined suitably with due considerations of the relationships with characteristics of other layer regions provided in direct contact with said layer region or the characteristics at the contacted interface with said other layer regions.

In the present invention, the content of the substance (C) for controlling conductivity contained in the layer region (PN) should preferably be 0.01 to $5\times10^4$ atomic ppm, more preferably 0.5 to $1\times10^4$ atomic ppm, most preferably 1 to $5\times10^3$ atomic ppm.

In the present invention, by making the content of said substance (C) in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the substrate side into the light-receiving layer can be effectively inhibited when the free surface of the light-receiving layer is subjected to the charging treatment to + polarity. On the other hand, when the substance to be incorporated is a n-type impurity, migration of positive holes injected from the substrate side into the light-receiving layer may be effectively inhibited when the free surface of the light-receiving layer is subjected to the charging treatment to ⊖ polarity.

In the case as mentioned above, the layer region (Z) at the portion excluding the above layer region (PN) under the basic constitution of the present invention as described above may contain a substance for controlling conductivity of the other polarity, or a substance for controlling conductivity having characteristics of the same polarity may be contained therein in an amount by far smaller than that practically contained in the layer region (PN).

In such a case, the content of the substance (C) for controlling conductivity contained in the above layer region (Z) can be determined adequately as desired depending on the polarity or the content of the substance contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the layer region (PN) and the layer region (Z), the content in the layer region (Z) should preferably be 30 atomic ppm or less.

In the present invention, it is also possible to provide a layer region containing a substance for controlling conductivity having one polarity and a layer region containing a substance for controlling conductivity having the other polarity in direct contact with each other, thus providing a so called depletion layer at said contact region.

In short, for example, a layer containing the aforesaid p-type impurity and a layer region containing the aforesaid n-type impurity are provided in the light-receiving layer in direct contact with each other to form the so called p-n junction, whereby a depletion layer can be provided.

FIGS. 27 through 35 show typical examples of the depth profiles in the layer thickness direction of the substance (C) contained in the layer region (PN) in the light-receiving layer of the present invention. In each of these Figures, representations of layer thickness and concentration are shown in rather exaggerated forms for illustrative purpose, since the difference between respective Figures will be indistinct if represented by the real values as such, and it should be understood that these Figures are schematic in nature. As practical distribution, the values of ti ($1<i<9$) or Ci ($1<i<17$) should be chosen so as to obtain desired distribution concentration lines, or values obtained by multiplying the distribution curve as a whole with an appropriate coefficient should be used.

In FIGS. 27 through 35, the abscissa shows the distribution concentration C of the substance (C), and the ordinate the layer thickness of the layer region (PN), $t_B$ indicating the position of the end surface on the substrate side of the layer region (G) and $t_T$ the position of the end surface on the side opposite to the substrate side. Thus, layer formation of the layer region (PN) containing the substance (C) proceeds from the $t_B$ side toward the $t_T$ side.

Figure 27:
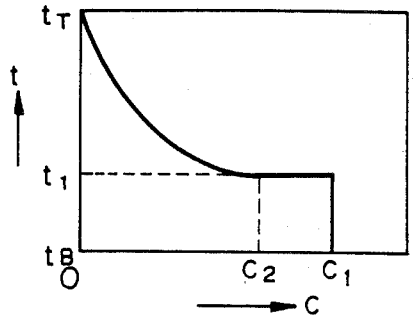
FIGS. 27 through 35 are schematic illustrations of the distribution state of the substance (C) in the layer region (PN).

FIG. 27 shows a first typical example of the depth profile of the substance (C) in the layer thickness direction contained in the layer region (PN).

In the embodiment shown in FIG. 27, from the interface position $t_B$ where the surface at which the layer region (PN) containing the substance (C) contacts the surface of said layer (G) to the position $t_1$, the substance (C) is contained in the layer region (PN) formed while the distribution concentration C of the substance (C) taking a constant value of $C_1$, and the concentration is gradually decreased from the concentration $C_2$ continuously from the position $t_1$ to the interface position $t_T$. At the interface position $t_T$, the distribution concentration C of the substance (C) is made substantially zero (here substantially zero means the case of less than detectable limit).

Figure 28:
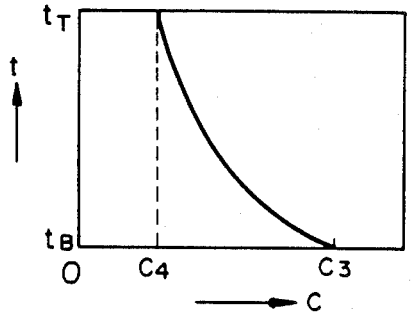

In the embodiment shown in FIG. 28, the distribution concentration C of the substance (C) contained is decreased from the position $t_B$ to the position $t_T$ gradually and continuously from the concentration $C_3$ to the concentration $C_4$ at $t_T$.

Figure 29:
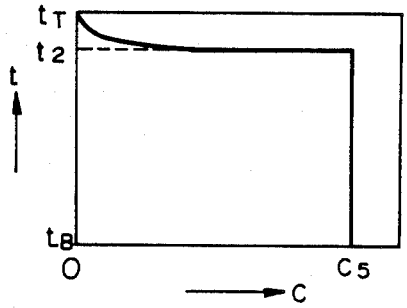

In the case of FIG. 29, from the position $t_B$ to the position $t_2$, the distribution concentration C of the substance (C) is made constantly at $C_5$, while between the position $t_2$ and the position $t_T$, it is gradually and continuously decreased, until the distribution concentration is made substantially zero at the position $t_T$.

Figure 30:
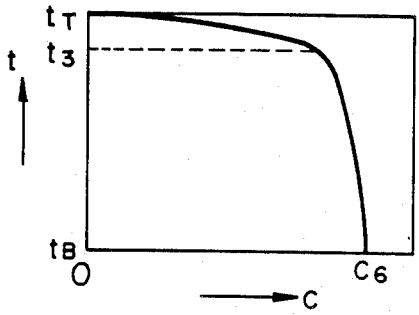

In the case of FIG. 30, the distribution concentration C of the substance (C) is first decreased continuously and gradually from the concentration $C_6$ from the position $t_B$ to the position $t_3$, from where it is abruptly decreased to substantially zero at the position $t_T$.

Figure 31:
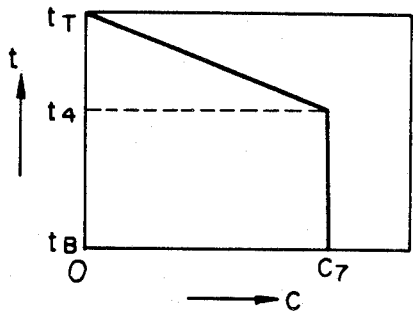

In the embodiment shown in FIG. 31, the distribution concentration of the substance (C) is constantly $C_7$ between the position $t_B$ and the position $t_T$, and the distribution concentration is made zero at the position $t_T$. Between the $t_4$ and the position $t_T$, the distribution concentration C is decreased as a first order function from the position $t_4$ to the position $t_T$.

Figure 32:
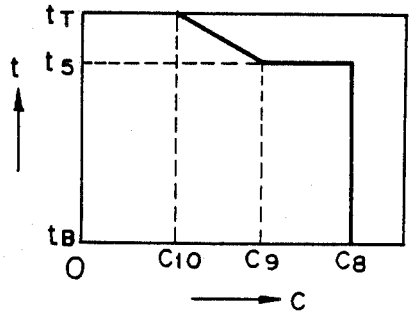

In the embodiment shown in FIG. 32, the distribution concentration C takes a constant value of $C_8$ from the position $t_B$ to the position $t_5$, while it was decreased as a first order function from the concentration $C_9$ to the concentration $C_{10}$ from the position $t_5$ to the position $t_T$.

Figure 33:
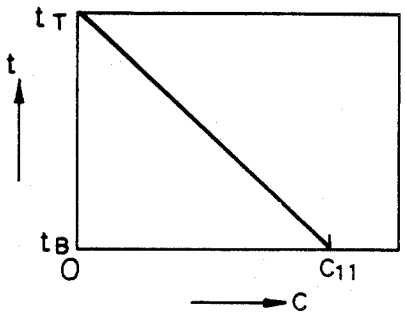

In the embodiment shown in FIG. 33, from the position $t_B$ to the position $t_T$, the distribution concentration C of the substance (C) is decreased continuously as a first order function from the concentration $C_{11}$ to zero.

Figure 34:
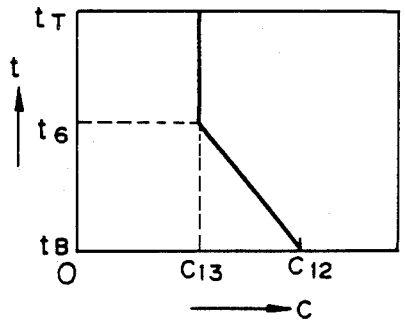

In FIG. 34, there is shown an embodiment, in which, from the position $t_B$ to the position $t_6$, the distribution concentration C of the substance C is decreased as a first order function from the concentration $C_{12}$ to the concentration $C_{13}$, and the concentration is made a constant value of $C_{13}$ between the position $t_6$ and the position $t_T$.

Figure 35:
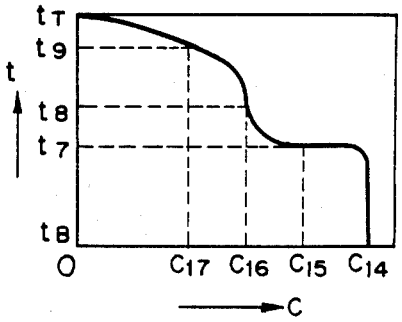

In the embodiment shown in FIG. 35, the distribution concentration C of the substance (C) is $C_{14}$ at the position $t_B$, which is gradually decreased initially from $C_{14}$ and then abruptly near the position $t_7$, where it is made $C_{15}$ at the position $t_7$.

Between the position $t_7$ and the position $t_8$, the concentration is initially abruptly decreased and then moderately gradually, until it becomes $C_{16}$ at the position $t_8$, and between the position $t_8$ and the position $t_9$, the concentration is gradually decreased to reach $C_{17}$ at the position $t_9$. Between the position $t_9$ and the position $t_T$, the concentration is decreased from $C_{17}$, following the curve with a shape as shown in Figure, to substantially zero.

As described above by referring to some typical examples of depth profiles in the layer thickness direction of the substance (C) contained in the layer region (PN) shown FIGS. 27 through 35, it is desirable in the present invention that a depth profile of the substance (C) should be provided in the layer region (PN) so as to have a portion with relatively higher distribution concentration C of the substance (C) on the substrate side, while having a portion on the interface $t_T$ side where said distribution concentration is made considerably lower as compared with the substrate side.

The layer region (PN) constituting the light-receiving member in the present invention is desired to have a localized region (B) containing the substance (C) preferably at a relatively higher concentration on the substrate side as described above.

In the present invention, the localized region (B) as explained in terms of the symbols shown in FIGS. 27 through 35, may be desirably provided within 5$\mu$ from the interface position $t_B$.

In the present invention, the above localized region (B) may be made to be identical with the whole of the layer region (L) from the interface position $t_B$ to the thickness of 5$\mu$, or alternatively a part of the layer region (L).

It may suitably be determined depending on the characteristics required for the light-receiving layer to be formed whether the localized region (B) should be made a part or the whole of the layer region (L).

For formation of the layer region (PN) containing the aforesaid substance (C) by incorporating a substance (C) for controlling conductivity such as the group III atoms or the group V atoms structurally into the light-receiving layer, a starting material for introduction of the group III atoms or a starting material for introduction of the group V atoms may be introduced under gaseous state into a deposition chamber together with other starting materials for formation of the respective layers during layer formation.

As the starting material which can be used for introduction of the group III atoms, it is desirable to use those which are gaseous at room temperature under atmospheric pressure or can readily be gasified under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydrides such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, SbCl, $BiH_3$, $BiCl_3$, $BiBr_3$ and the like effectively as the starting material for introduction of the group V atoms.

The substrate to be used in the present invention may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. At least one side surface of these substrates is preferably subjected to treatment for imparting electroconductivity, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 1004 in FIG. 10 is to be used as the light-receiving member for electrophotography, it may desirably be formed into an endless belt or a cylinder for use in continuous high speed copying. The substrate may have a thickness, which is conveniently determined so that the light-receiving member as desired may be formed. When the light-receiving member is required to have a flexibility, the substrate is made as thin as possible, so far as the function of a support can be exhibited. However, in such a case, the thickness is generally $10\mu$ or more from the points of fabrication and handling of the substrate as well as its mechanical strength.

Figure 26:
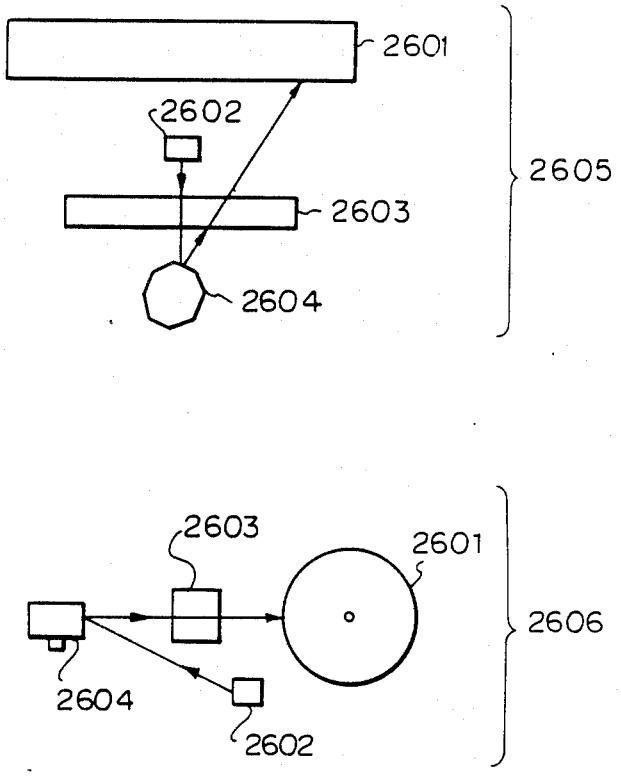
FIG. 26 is a schematic illustration of the image exposure device employed in Examples.

FIG. 26 is a schematic illustration of an example of the image forming device employing electrophotographic technique in which the light receiving member of the present invention is mounted.

In this Figure, 2601 is a drum-shaped light receiving member of the present invention prepared for use in electrophotography, 2602 is a semiconductor laser device which is the light source for apply exposure on the light receiving member 2601 corresponding to the information to be recorded, 2603 is a $f\theta$ lens, 2604 is a polygon-mirror, 2605 shows the plane view of the device and 2606 shows the side view of the device.

In FIG. 26, devices to be generally employed for practicing electrophotographic image formation, such as developing device, transfer device fixing device, cleaning device, etc., are not shown.

Next, an example of the process for producing the light-receiving member of this invention is to be briefly described.

Figure 20:
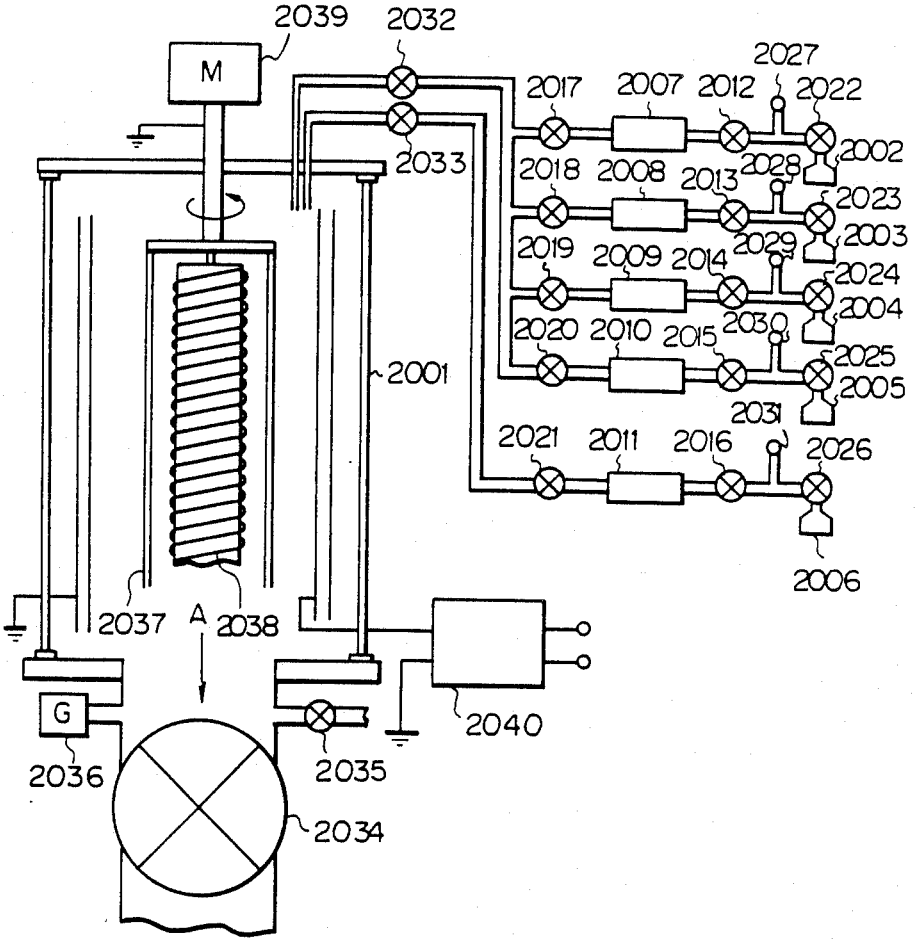
FIG. 20 is a schematic illustration of the vacuum deposition device for preparation of the light-receiving members employed in Examples.

FIG. 20 shows one example of a device for producing a light-receiving member.

In the gas bombs 2002 to 2006, there are hermetically contained starting gases for formation of the light receiving member of the present invention. For example, 2002 is a bomb containing $SiH_4$ gas (purity 99.999%, hereinafter abbreviated as $SiH_4$), 2003 is a bomb containing $GeH_4$ gas (purity 99.999%, hereinafter abbreviated as $GeH_4$), 2004 is a bomb containing $SiF_4$ gas (purity 99.99%, hereinafter abbreviated as $SiF_4$), 2005 is bomb containing $B_2H_6$ gas diluted with $H_2$ (purity 99.999%, hereinafter abbreviated as $B_2H_6/H_2$) and 2006 is a bomb containing $H_2$ gas (purity: 99.999%).

For allowing these gases to flow into the reaction chamber 2001, on confirmation of the valves 2022 to 2026 of the gas bombs 2002 to 2006 and the leak valve 2035 to be closed, and the inflow valves 2012 to 2016, the outflow valves 2017 to 2021 and the auxiliary valves 2032 and 2033 to be opened, the main valve 2034 is first opened to evacuate the reaction chamber 2001 and the gas pipelines. As the next step, when the reading on the vacuum indicator 2036 becomes above $5\times10^{-6}$ Torr, the auxiliary valves 2032, 2033 and the outflow valves 2017 to 2021 are closed.

Referring now to an example of forming a light receiving layer on the cylindirical substrate 2037, $SiH_4$ gas from the gas bomb 2002, $GeH_4$ gas from the gas bomb 2003, $B_2H_6/H_2$ gas from the gas bomb 2005 and $H_2$ gas from the gas bomb 2006 are permitted to flow into the mass-flow controllers 2007, 2008 2010 and 2011, respectively, by opening the valves 2022, 2023, 2025 and 2026 and controlling the pressures at the output pressure gauges 2027, 2028, 2030 and 2031 to 1 $Kg/cm^2$ and opening gradually the inflow valves, 2012, 2013, 2015 and 2016, respectively. Subsequently, the outflow valves 2017, 2018, 2020 and 2021 and the auxiliary valves 2032 and 2033 were gradually opened to permit respective gases to flow into the reaction chamber 2001. The outflow valves 2017, 2018, 2020 and 2021 are controlled so that the flow rate ratio of $SiH_4$ gas, $GeH_4$ gas, $B_2H_6/H_2$ gas, and $H_2$ gas may have a desired value and opening of the main valve 2034 is also controlled while watching the reading on the vacuum indicator 2036 so that the pressure in the reaction chamber 2001 may reach a desired value. And, after confirming that the temperature of the substrate 2037 is set at 50° C. to 400° C. by the heater 2038, the power source 2040 is set at a desired power to excite glow discharge in the reaction chamber 2001, simultaneously with controlling of the distribution concentrations of germanium atoms and boron atoms to be contained in the layer formed by carrying out the operation to change gradually the openings of the valves 2018, 2020 by the manual method or by means of an externally driven motor, etc. thereby changing the flow rates of $GeH_4$ gas and $B_2H_6$ gas according to previously designed change rate curves.

By maintaining the glow discharge as described above for a desired period time the first layer (G) is formed on the substrate 2037 to a desired thickness. At the stage when the first layer (G) is formed to a desired thickness, the second layer (S) containing substantially no germanium atom can be formed on the first layer (G) by maintaining glow discharge according to the same conditions and procedure as those in formation of the first layer (G) except for closing completely the outflow valve 2018 and changing, if desired, the discharging conditions. Also, in the respective layers of the first layer (G) and the second layer (S), by opening or closing as desired the outflow valve 2020, boron atoms may be contained or not, or boron atoms may be contained only in a part of the layer region of the respective layers.

On the light receiving member whose layers up to the above second layer (S) have been formed, the surface layer is formed according to the sputtering method.

In the device shown in FIG. 20, a material for the surface layer is placed all over the cathode electrode and $H_2$ gas is replaced with Ar gas.

Next, the light receiving member whose layers up to the second layer (S) have been formed is set in the devide, followed by sufficient evacuation of the device, and then Ar gas is introduced to a predetermined inner pressure. And, by introduction of a predetermined high frequency power, the material on the cathode electrode is sputtered to form the surface layer on the second layer (S).

During layer formation, it is desirable to rotate the substrate 2037 by a motor 2039 in order to effect uniformization of layer formation.

The present invention is described in more detail by referring to the following Examples.

EXAMPLE 1

Figure 21A:
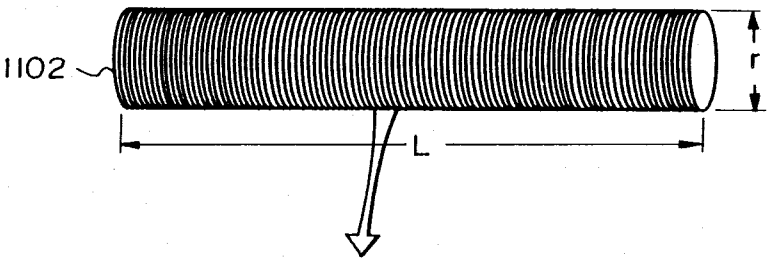
FIGS. 21(A), (B) and (C) and FIGS. 43 through 45 illustrations of the surface states of the aluminum substrates employed in Examples.
Figure 21B:
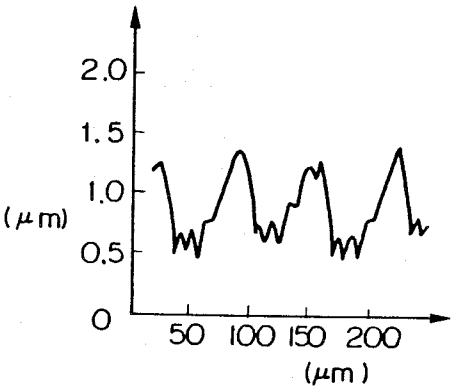

By means of a lathe, an aluminum substrate (length (L): 357 mm, outerdiameter (r): 80 mm) was worked to have the surface characteristic as shown in FIG. 21(B).

Next, A-Si type light-receiving members for electrophotography were deposited on the above aluminum substrate following various procedures under the condition No. 101 in Table 1 and the conditions as shown in Table 2A using the deposition device as shown in FIG. 20.

Formation of the surface layer was carried out as follows. After formation of the second layer, the hydrogen ($H_2$) bomb was replaced with argon (Ar) gas bomb, the deposition device cleaned and the material for the surface layer as shown in the condition 101 in Table 1 was placed on the entire surface of the cathode electrode. The above light-receiving layer was set in the device, and the deposition device is brought to reduced pressure sufficiently by means of a diffusion pump. Then, argon gas was introduced to 0.015 Torr and glow discharging excited at a high frequency power of 150 W to sputter the surface layer material, thereby forming the surface layer of the conditions No. 101 in Table 1 on the substrate.

Figure 21C:
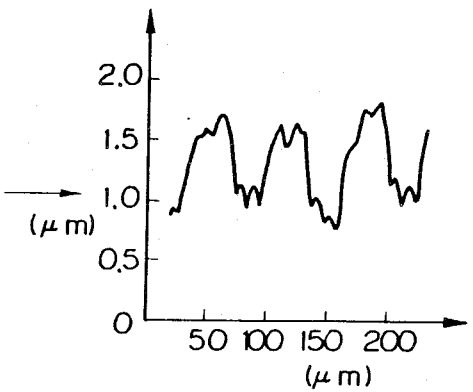

The surface state of the light-receiving member for electrophotography of A-Si:H thus prepared was as shown in FIG. 21(C).

According to the same method as described above except for forming the surface layer as shown by the conditions 102 to 122 in Table 1, light-receiving members were prepared.

The light-receiving members for electrophotography as prepared above were subjected to image exposure by means of a device as shown in FIG. 26 (wavelength of laser beam: 780 nm, spot diameter 80 μm), followed by development and transfer to obtain images. The images were free from any interference fringe pattern observed and proved to be satisfactory for practical application.

EXAMPLE 2

Figure 43:
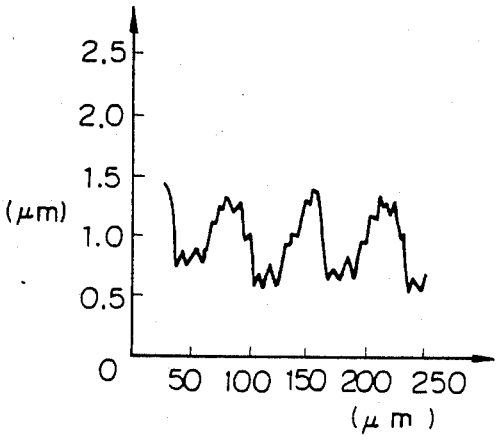
Figure 44:
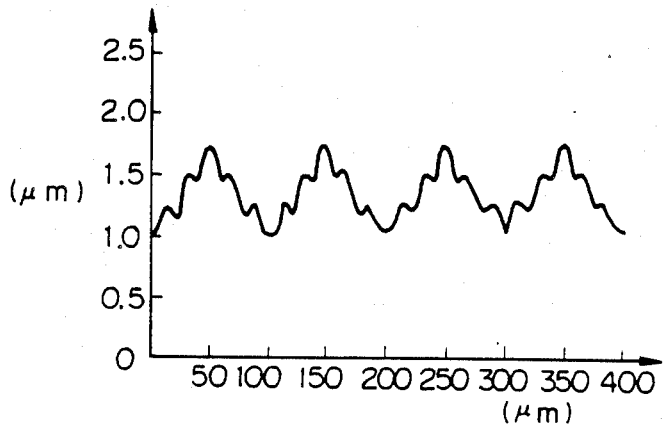
Figure 45:
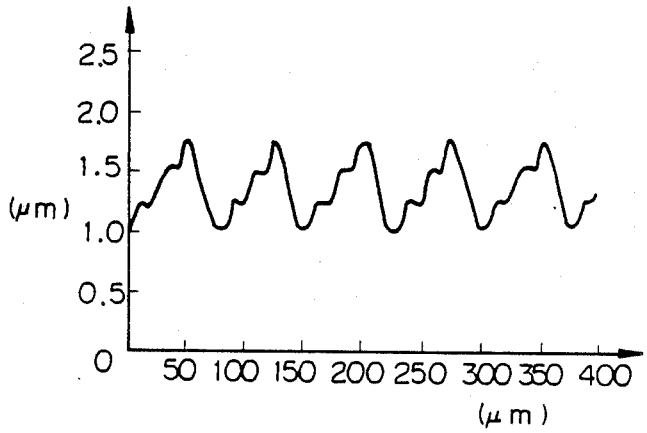

On cylindrical aluminum substrates having the surface characteristics as shown in FIG. 43, FIG. 44 and FIG. 45, light-receiving members for electrophotography were prepared under the conditions as shown in Table 3A.

For these light-receiving members for electrophotography, image exposure was effected by means of the same image exposure device as in Example 1, followed by developing, transfer and fixing, to obtain visible images on plain papers.

The images obtained were free from any interference fringe pattern observed and proved to be satisfactory for practical application.

EXAMPLE 3

Figure 1:
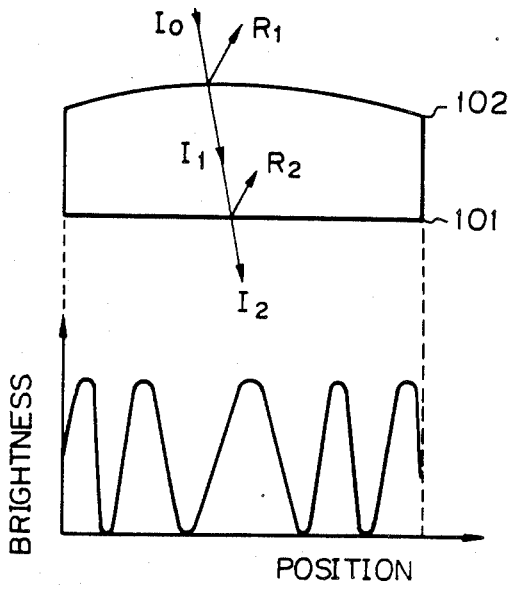
FIG. 1 is a schematic illustration of interference fringe in general.
Figure 2:
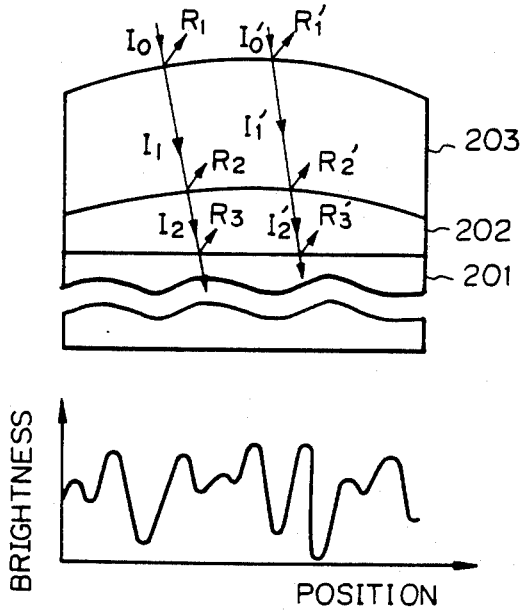
FIG. 2 is a schematic illustration of interference fringe in the case of a multi-layer light-receiving member.
Figure 3:
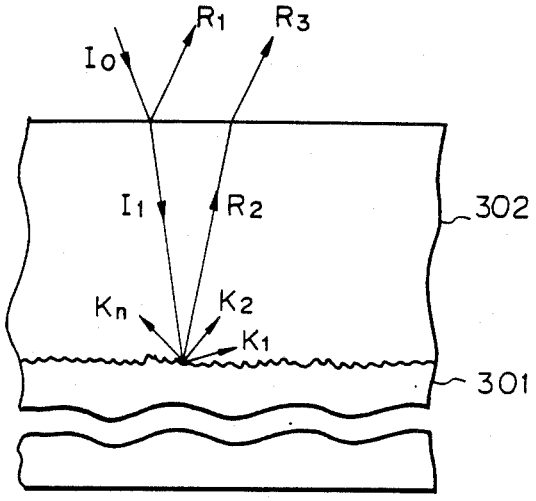
FIG. 3 is a schematic illustration of interference fringe by scattered light.
Figure 4:
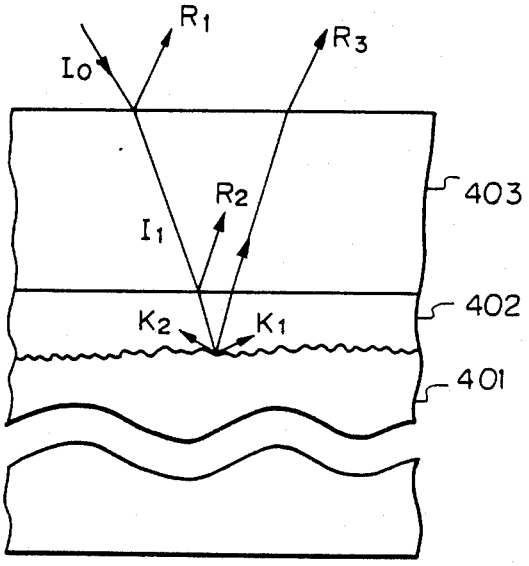
FIG. 4 is a schematic illustration of interference fringe by scattered light in the case of a multi-layer light-receiving member.
Figure 5:
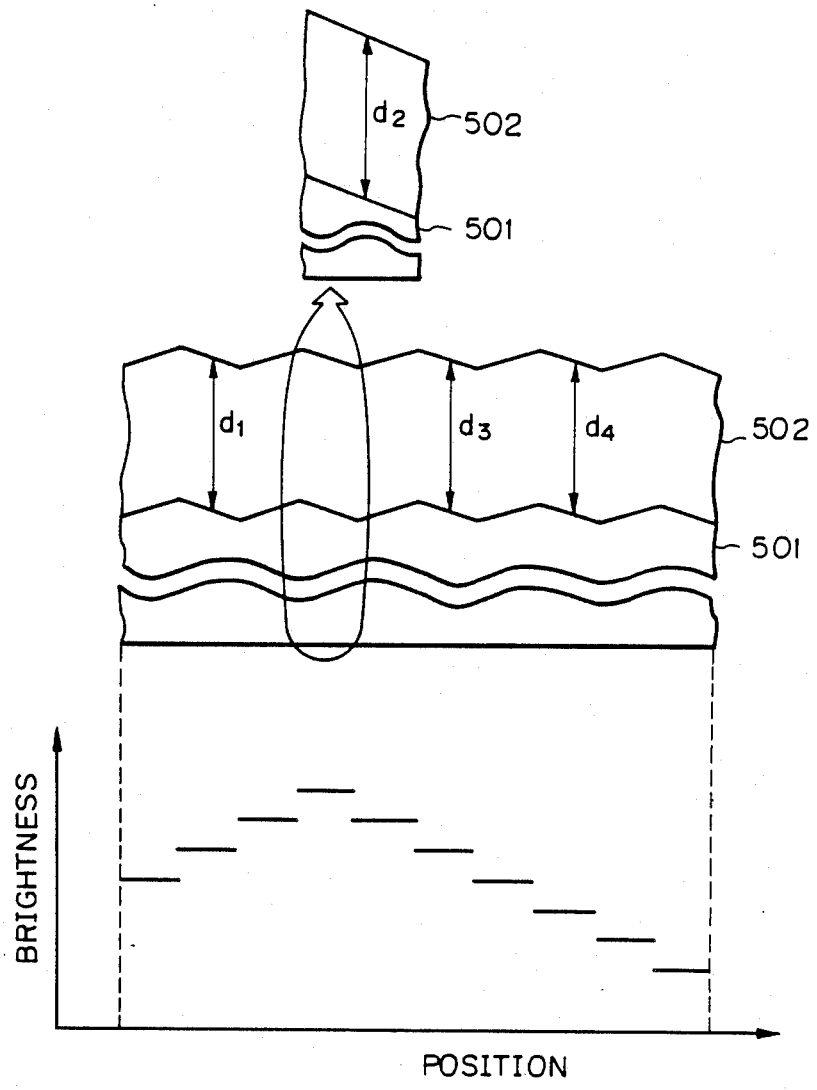
FIG. 5 is a schematic illustration of interference fringe in the case where the interfaces of respective layers of a light-receiving member are parallel to each other.
Figure 6A:
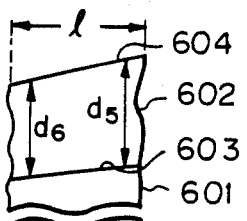
FIGS. 6(A), (B), (C) and (D) are schemat;c illustrations of no appearance of interference fringe in the case of non-parallel interfaces between respective layers of a light-receiving member.
Figure 6B:
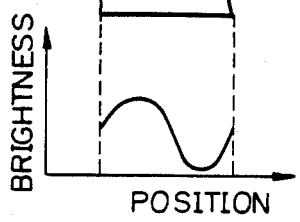
Figure 6C:
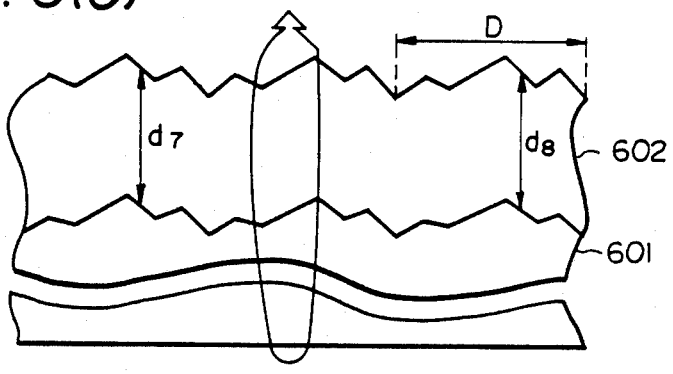
Figure 6D:
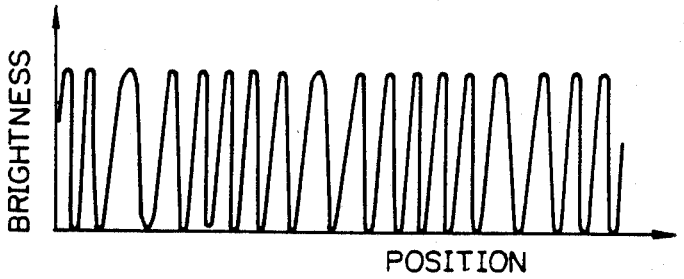

On cylindrical aluminum substrates having the surface characteristics as shown in FIG. 43, FIG. 44 and FIG. 45, light-receiving members for electrophotography were prepared under the conditions as shown in FIG. 4A.

For these light-receiving members for electrophotography, image exposure was effected by means of the same image exposure device as in Example 1, followed by developing, transfer and fixing, to obtain visible images on plain papers.

The image obtained were free from any interference fringe pattern observed and proved to be satisfactory for practical application.

EXAMPLE 4

On cylindrical aluminum substrates having the surface characteristics as shown in FIG. 43, FIG. 44 and FIG. 45, light-receiving members for electrophotography were prepared under the conditions as shown in Table 5A.

For these light-receiving members for electrophotography, image exposure was effected by means of the same image exposure device as in Example 1, followed by developing, transfer and fixing, to obtain visible images on plain papers.

The images obtained were free from any interference fringe pattern observed and proved to be satisfactory for practical application.

EXAMPLE 5

By means of a lathe, an aluminum substrate (length (L): 357 mm, outerdiameter (r): 80 mm) was worked to have the surface characteristic as shown in FIG. 21(B).

Next, A-Si type light-receiving members for electrophotography were deposited on the above aluminum substrate following various procedures under the condition No. 101 in Table 1 and the conditions as shown in Table 2B using the deposition device as shown in FIG. 20.

Figure 22:
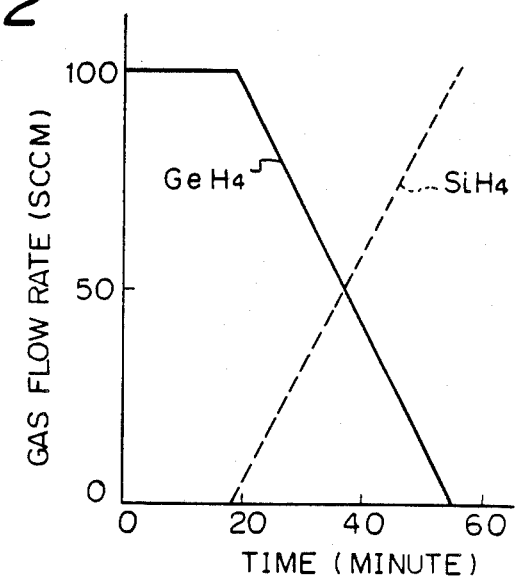
FIGS. 22 through 25, FIGS. 36 through 42 and FIGS. 46 through 49, are schematic illustrations of the changes in gas flow rates of the respective gases in Examples.

In preparation of the first layer of a-Si:Ge:H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

Formation of the surface layer was carried out as follows. After formation of the second layer, the hydrogen ($H_2$) bomb was replaced with argon (Ar) gas bomb, the deposition device cleaned and the material for the surface layer as shown in the condition 101 in Table 1 was placed on the entire surface of the cathode electrode. The above light-receiving layer was set in the device, and the deposition device is brought to reduced pressure sufficiently by means of a diffusion pump. Then, argon gas was introduced to 0.015 Torr and glow discharging excited at a high frequency power of 150 W to sputter the surface layer material, thereby forming the surface layer of the conditions No. 101 in Table 1 on the substrate.

The surface state of the light-receiving member for electrophotography of A-Si:H thus prepared was as shown in FIG. 21(C).

According to the same method as described above except for forming the surface layer as shown by the conditions 102 to 122 in Table 1, light-receiving members were prepared.

The light-receiving members for electrophotography as prepared above were subjected to image exposure by means of a device as shown in FIG. 26 (wavelength of laser beam: 780 nm, spot diameter 80 μm), followed by development and transfer to obtain images. The images were free from any interference fringe pattern observed and proved to be satisfactory for practical application.

EXAMPLE 6

On cylindrical aluminum substrates having the surface characteristics as shown in FIG. 43, FIG. 44 and FIG. 45, light-receiving members for electrophotography were prepared under the conditions as shown in Table 1 and Table 2B, following otherwise the same conditions as in Example 5.

Figure 23:
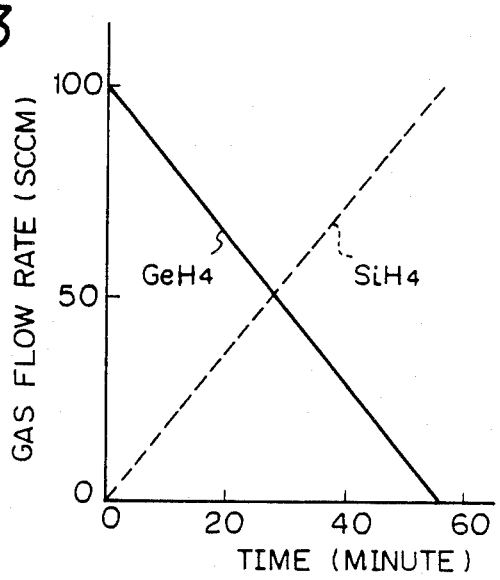

In preparation of the first layer of a-Si:Ge:H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, image exposure was effected by means of the same image exposure device as in Example 5, followed by developing, transfer and fixing, to obtain visible images on plain papers.

The images obtained were free from any interference fringe pattern observed and proved to be satisfactory for practical application.

EXAMPLE 7

On cylindrical aluminum substrates having the surface characteristics as shown in FIG. 43, FIG. 44 and FIG. 45, light-receiving members for electrophotography were prepared under the conditions as shown in Table 3B, following otherwise the same conditions as in Example 5.

Figure 24:
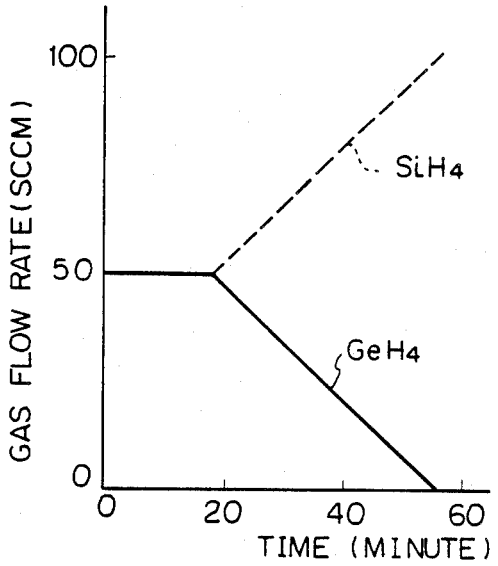

In preparation of the first layer of a-Si:Ge:H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 24.

For these light-receiving members for electrophotography, image exposure was effected by means of the same image exposure device as in Example 5, followed by developing, transfer and fixing, to obtain visible images on plain papers.

The images obtained were free from any interference fringe pattern observed and proved to be satisfactory for practical application.

EXAMPLE 8

On cylindrical aluminum substrates having the surface characteristics as shown in FIG. 43, FIG. 44 and FIG. 45, light-receiving members for electrophotography were prepared under the conditions as shown in Table 3B, following otherwise the same conditions as in Example 5.

Figure 25:
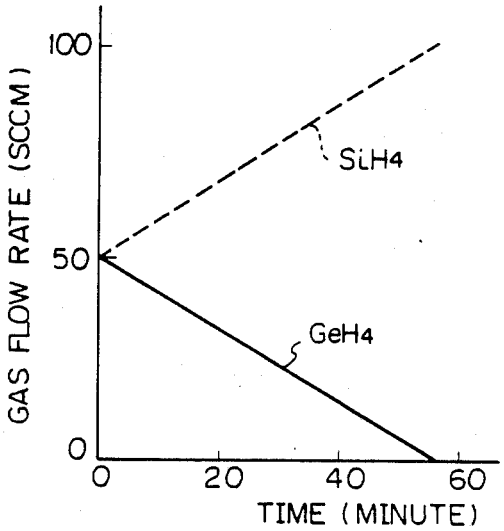

In preparation of the first layer of a-Si:Ge:H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, image exposure was effected by means of the same image exposure device as in Example 5, followed by developing, transfer and fixing, to obtain visible images on plain papers.

The images obtained were free from any interference fringe pattern observed and proved to be satisfactory for practical application.

EXAMPLE 9

By means of a lathe, an aluminum substrate (length (L): 357 mm, outerdiameter (r): 80 mm) was worked to have the surface characteristic as shown in FIG. 21(B).

Next, A-Si type light-receiving members for electrophotography were deposited on the above aluminum substrate following various procedures under the condition No. 101 in Table 1 and the conditions as shown in Table 2C using the deposition device as shown in FIG. 20.

Formation of the surface layer was carried out as follows. After formation of the second layer, the hydrogen ($H_2$) bomb was replaced with argon (Ar) gas bomb, the deposition device cleaned and the material for the surface layer as shown in the condition 101 in Table 1 was placed on the entire surface of the cathode electrode. The above light-receiving layer was set in the device, and the deposition device is brought to reduced pressure sufficiently by means of a diffusion pump. Then, argon gas was introduced to 0.015 Torr and glow discharging excited at a high frequency power of 150 W to sputter the surface layer material, thereby forming the surface layer of the conditions No. 101 in Table 1 on the substrate.

The surfacc state of the light-receiving member for electrophotography of A-Si:H thus prepared was as shown in FIG. 21(C).

According to the same method as described above except for forming the surface layer as shown by the conditions 102 to 122 in Table 1, light-receiving members were prepared.

The light-receiving members for electrophotography as prepared above were subjected to image exposure by means of a device as shown in FIG. 26 (wavelength of laser beam: 780 nm, spot diameter 80 μm), followed by development and transfer to obtain images. The images were free from any interference fringe pattern observed and proved to be satisfactory for practical application.

EXAMPLE 10

On cylindrical aluminum substrates having the surface characteristics as shown in FIG. 43, FIG. 44 and FIG. 45, light-receiving members for electrophotography were prepared under the conditions as shown in Table 3C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 11

On cylindrical aluminum substrates having the surface characteristics as shown in FIG. 43, FIG. 44 and FIG. 45, light-receiving members for electrophotography were prepared under the conditions as shown in Table 4C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 12

On cylindrical aluminum substrates having the surface characteristics as shown in FIG. 43, FIG. 44 and FIG. 45, light-receiving members for electrophotography were prepared under the conditions as shown in Table 5C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 13

On cylindrical aluminum substrates having the surface characteristics as shown in FIG. 43, FIG. 44 and FIG. 45, light-receiving members for electrophotography were prepared under the conditions as shown in Table 6C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 14

On cylindrical aluminum substrates having the surface characteristics as shown in FIG. 43, FIG. 44 and FIG. 45, light-receiving members for electrophotography were prepared under the conditions as shown in Table 7C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 15

On cylindrical aluminum substrates having the surface characteristics as shown in FIG. 43, FIG. 44 and FIG. 45, light-receiving members for electrophotography were prepared under the conditions as shown in Table 8C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 16

On cylindrical aluminum substrates having the surface characteristics as shown in FIG. 43, FIG. 44 and FIG. 45, light-receiving members for electrophotography were prepared under the conditions as shown in Table 9C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 17

On cylindrical aluminum substrates having the surface characteristics as shown in FIG. 43, FIG. 44 and FIG. 45, light-receiving members for electrophotography were prepared under the conditions as shown in Table 10C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 18

On cylindrical aluminum substrates having the surface characteristics as shown in FIG. 43, FIG. 44 and FIG. 45, light-receiving members for electrophotography were prepared under the conditions as shown in Table 11C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 19

On cylindrical aluminum substrates having the surface characteristics as shown in FIG. 43, FIG. 44 and FIG. 45, light-receiving members for electrophotography were prepared under the conditions as shown in Table 12C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 20

On cylindrical aluminum substrates having the surface characteristics as shown in FIG. 43, FIG. 44 and FIG. 45, light-receiving members for electrophotography were prepared under the conditions as shown in Table 13C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 21

On cylindrical aluminum substrates having the surface characteristics as shown in FIG. 43, FIG. 44 and FIG. 45, light-receiving members for electrophotography were prepared under the conditions as shown in Table 14C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 22

On cylindrical aluminum substrates having the surface characteristics as shown in FIG. 43, FIG. 44 and FIG. 45, light-receiving members for electrophotography were prepared under the conditions as shown in Table 15C, following otherwise the same procedure as in Example 9.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 23

Examples 9 to 22 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively. Other preparation conditions were the same as in Examples 9 to 22.

For these light-receiving members for electrophotography, image exposure was effected by means of the same image exposure device as in Example 9, followed by developing, transfer and fixing, to obtain visible images on plain papers.

The images obtained were free from any interference fringe pattern observed and proved to be satisfactory for practical application.

EXAMPLE 24

By means of a lathe, an aluminum substrate (length (L): 357 mm, outerdiameter (r): 80 mm) was worked to have the surface characteristic as shown in FIG. 21 (B).

Next, A-Si type light-receiving members for electrophotography were deposited on the above aluminum substrate following various procedures under the condition No. 101 in Table 1 and the conditions as shown in Table 2D using the deposition device as shown in FIG. 20.

In preparation of the first layer of a-Si:Ge:H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

Formation of the surface layer was carried out as follows. After formation of the second layer, the hydrogen ($H_2$) bomb was replaced with argon (Ar) gas bomb, the deposition device cleaned and the material for the surface layer as shown in the condition 101 in Table 1 was placed on the entire surface of the cathode electrode. The above light-receiving layer was set in the device, and the deposition device is brought to reduced pressure sufficiently by means of a diffusion pump. Then, argon gas was introduced to 0.015 Torr and glow discharging excited at a high frequency power of 150 W to sputter the surface layer material, thereby forming the surface layer of the conditions No. 101 in Table 1 on the substrate.

The surface state of the light-receiving member for electrophotography of A-Si:H thus prepared was as shown in FIG. 21 (C).

According to the same method as described above except for forming the surface layer as shown by the conditions 102 to 122 in Table 1, light-receiving members were prepared.

The light-receiving members for electrophotography as prepared above were subjected to image exposure by means of a device as shown in FIG. 26 (wavelength of laser beam: 780 nm, spot diameter 80 $\mu$m), followed by development and transfer to obtain images. The images were free from any interference fringe pattern observed and proved to be satisfactory for practical application.

EXAMPLE 25

On cylindrical aluminum substrate having the surface characteristics as shown in FIG. 43, a light-receiving member for electrophotography was prepared under the conditions as shown in Table 2D, following otherwise the same conditions as in Example 24.

In preparation of the first layer of a-Si:Ge:H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, image exposure was effected by means of the same image exposure device as in Example 24, followed by developing, transfer and fixing, to obtain visible images on plain papers.

The images obtained were free from any interference fringe pattern observed and proved to be satisfactory for practical application.

EXAMPLE 26

On cylindrical aluminum substrate having the surface characteristics as shown in FIG. 43, light-receiving members for electrophotography were prepared under the conditions as shown in Table 3D, following otherwise the same conditions as in Example 24.

In preparation of the first layer of a-Si:Ge:H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, image exposure was effected by means of the same image exposure device as in Example 24, followed by developing, transfer and fixing, to obtain visible images on plain papers.

The images obtained were free from any interference fringe pattern observed and proved to be satisfactory for practical application.

EXAMPLE 27

On cylindrical aluminum substrate having the surface characteristics as shown in FIG. 44, light-receiving members for electrophotography were prepared under the conditions as shown in Table 3D, following otherwise the same conditions as in Example 24.

In preparation of the first layer of a-Si:Ge:H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, image exposure was effected by means of the same image exposure device as in Example 24, followed by developing, transfer and fixing, to obtain visible images on plain papers.

The images obtained were free from any interference fringe pattern observed and proved to be satisfactory for practical application.

EXAMPLE 28

On cylindrical aluminum substrate having the surface characteristics as shown in FIG. 45, light-receiving members for electrophotography were prepared under the conditions as shown in Table 4D, following otherwise the same conditions as in Example 24.

In preparation of the first layer of a-Si:Ge:H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, image exposure was effected by means of the same image exposure device as in Example 24, followed by developing, transfer and fixing, to obtain visible images on plain papers.

The images obtained were free from any interference fringe pattern observed and proved to be satisfactory for practical application.

EXAMPLE 29

On cylindrical aluminum substrate having the surface characteristics as shown in FIG. 43, light-receiving members for electrophotography were prepared under the conditions as shown in Table 5D, following otherwise the same conditions as in Example 24.

In preparation of the first layer of a-Si:Ge:H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, image exposure was effected by means of the same image exposure device as in Example 24, followed by developing, transfer and fixing, to obtain visible images on plain papers.

The images obtained were free from any interference fringe pattern observed and proved to be satisfactory for practical application.

EXAMPLE 30

On cylindrical aluminum substrate having the surface characteristics as shown in FIG. 44, light-receiving members for electrophotography were prepared under the conditions as shown in Table 6D, following otherwise the same conditions as in Example 24.

In preparation of the first layer of a-Si:Ge:H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, image exposure was effected by means of the same image exposure device as in Example 24, followed by developing, transfer and fixing, to obtain visible images on plain papers.

The images obtained were free from any interference fringe pattern observed and proved to be satisfactory for practical application.

EXAMPLE 31

On cylindrical aluminum substrate having the surface characteristics as shown in FIG. 45, light-receiving members for electrophotography were prepared under the conditions as shown in Table 7D, following otherwise the same conditions as in Example 24.

In preparation of the first layer of a-Si:Ge:H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, image exposure was effected by means of the same image exposure device as in Example 24, followed by developing, transfer and fixing, to obtain visible images on plain papers.

The images obtained were free from any interference fringe pattern observed and proved to be satisfactory for practical application.

EXAMPLE 32

Examples 24 to 31 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively. Other preparation conditions were the same as in Examples 24 to 31.

The light-receiving members for electrophotography as prepared above were subjected to image exposure by means of a device as shown in FIG. 26 (wavelength of laser beam: 780 nm, spot diameter 80 $\mu$m), followed by development and transfer to obtain images. The images were free from any interference fringe pattern observed and proved to be satisfactory for practical application.

EXAMPLE 33

By means of a lathe, an aluminum substrate (length (L): 357 mm, outerdiameter (r): 80 mm) was worked to have the surface characteristic as shown in FIG. 21 (B).

Next, A-Si type light-receiving members for electrophotography were deposited on the above aluminum substrate following various procedures under the condition No. 101 in Table 1 and the conditions as shown in Table 2E using the deposition device as shown in FIG. 20.

Formation of the surface layer was carried out as follows. After formation of the second layer, the hydrogen ($H_2$) bomb was replaced with argon (Ar) gas bomb, the deposition device cleaned and the material for the surface layer as shown in the condition 101 in Table 1 was placed on the entire surface of the cathode electrode. The above light-receiving layer was set in the device, and the deposition device is brought to reduced pressure sufficiently by means of a diffusion pump. Then, argon gas was introduced to 0.015 Torr and glow discharging excited at a high frequency power of 150 W to sputter the surface layer material, thereby forming the surface layer of the conditions No 101 in Table 1 on the substrate.

The surface state of the light-receiving member for electrophotography of A-Si:H thus prepared was as shown in FIG. 21 (C).

According to the same method as described above except for forming the surface layer as shown by the conditions 102 to 122 in Table 1, light-receiving members were prepared.

The light-receiving members for electrophotography as prepared above were subjected to image exposure by means of a device as shown in FIG. 26 (wavelength of laser beam: 780 nm, spot diameter 80 μm), followed by development and transfer to obtain images. The images were free from any interference fringe pattern observed and proved to be satisfactory for practical application.

EXAMPLE 34

On cylindrical aluminum substrate having the surface characteristics as shown in FIG. 43, light-receiving members for electrophotography were prepared under the conditions as shown in Table 3E, following otherwise the same procedure as in Example 33.

For these light-receiving members for electro photography, image exposure was effected by means of the same image exposure device as in Example 33, followed by developing, transfer and fixing, to obtain visible images on plain papers.

The images obtained were free from any interference fringe pattern observed and proved to be satisfactory for practical application.

EXAMPLE 35

On cylindrical aluminum substrate having the surface characteristics as shown in FIG. 44, light-receiving members for electrophotography were prepared under the conditions as shown in Table 4E, following otherwise the same procedure as in Example 33.

For these light-receiving members for electrophotography, image exposure was effected by means of the same image exposure device as in Example 33, followed by developing, transfer and fixing, to obtain visible images on plain papers.

The images obtained were free from any interference fringe pattern observed and proved to be satisfactory for practical application.

EXAMPLE 36

On cylindrical aluminum substrate having the surface characteristics as shown in FIG. 45, light-receiving members for electrophotography were prepared under the conditions as shown in Table 5E, following otherwise the same procedure as in Example 33.

For these light-receiving members for electrophotography, image exposure was effected by means of the same image exposure device as in Example 33, followed by developing, transfer and fixing, to obtain visible images on plain papers.

The images obtained were free from any interference fringe pattern observed and proved to be satisfactory for practical application.

EXAMPLE 37

On cylindrical aluminum substrate having the surface characteristics as shown in FIG. 43, light-receiving members for electrophotography were prepared under the conditions as shown in Table 6E, following otherwise the same procedure as in Example 33.

Figure 46:
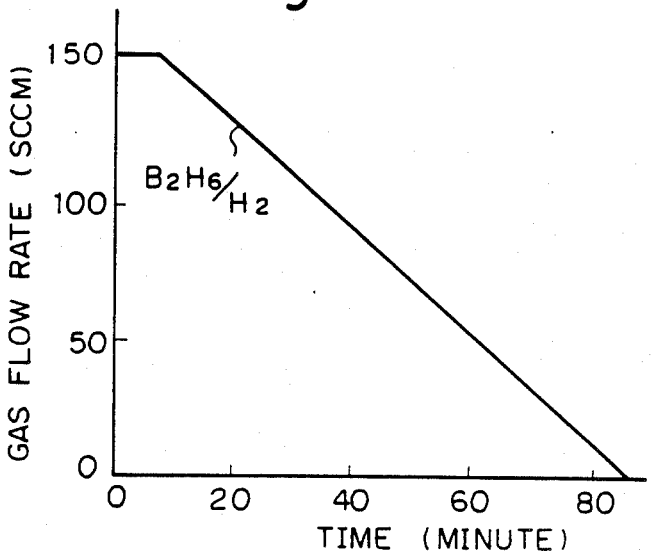

The boron-containing layer was formed by controlling the mass flow controller 2010 for $B_2H_6/H_2$ by means of a computer (HP9845B) so that the flow rate of $B_2H_6/H_2$ might be as shown in FIG. 46.

For these light-receiving members for electrophotography, image exposure was effected by means of the same image exposure device as in Example 33, followed by developing, transfer and fixing, to obtain visible images on plain papers.

The images obtained were free from any interference fringe pattern observed and proved to be satisfactory for practical application.

EXAMPLE 38

On cylindrical aluminum substrate having the surface characteristics as shown in FIG. 44, light-receiving members for electrophotography were prepared under the conditions as shown in Table 7E, following otherwise the same procedure as in Example 33.

Figure 47:
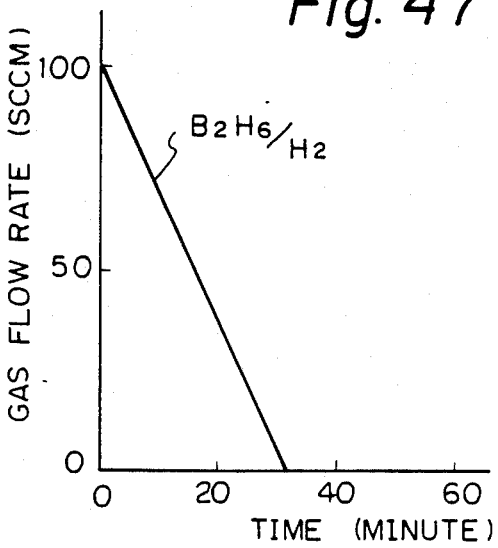

The boron-containing layer was formed by controlling the mass flow controller 2010 for $B_2H_6/H_2$ by means of a computer (HP9845B) so that the flow rate of $B_2H_6/H_2$ might be as shown in FIG. 47.

For these light-receiving members for electrophotography, image exposure was effected by means of the same image exposure device as in Example 33, followed by developing, transfer and fixing, to obtain visible images on plain papers.

The images obtained were free from any interference fringe pattern observed and proved to be satisfactory for practical application.

EXAMPLE 39

On cylindrical aluminum substrate having the surface characteristics as shown in FIG. 45, light-receiving members for electrophotography were prepared under the conditions as shown in Table 8E, following otherwise the same procedure as in Example 33.

Figure 48:
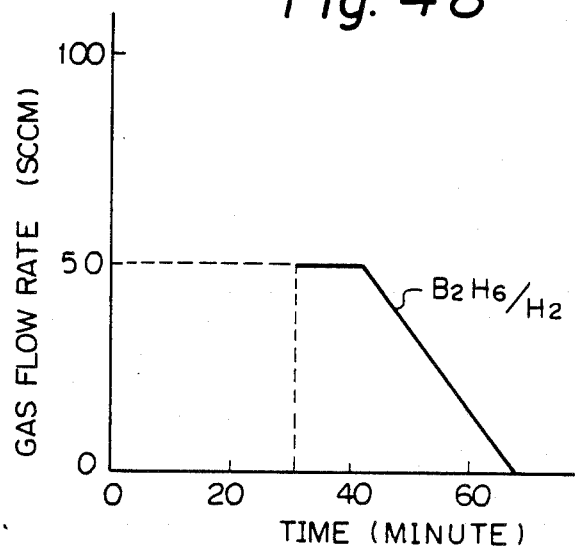

The boron-containing layer was formed by controlling the mass flow controller 2010 for $B_2H_6/H_2$ by means of a computer (HP9845B) so that the flow rate of $B_2H_6/H_2$ might be as shown in FIG. 48.

For these light-receiving members for electrophotography, image exposure was effected by means of the same image exposure device as in Example 33, followed by developing, transfer and fixing, to obtain visible images on plain papers.

The images obtained were free from any interference fringe pattern observed and proved to be satisfactory for practical application.

EXAMPLE 40

On cylindrical aluminum substrate having the surface characteristics as shown in FIG. 43, light-receiving members for electrophotography were prepared under the conditions as shown in Table 9E, following otherwise the same procedure as in Example 33.

Figure 49:
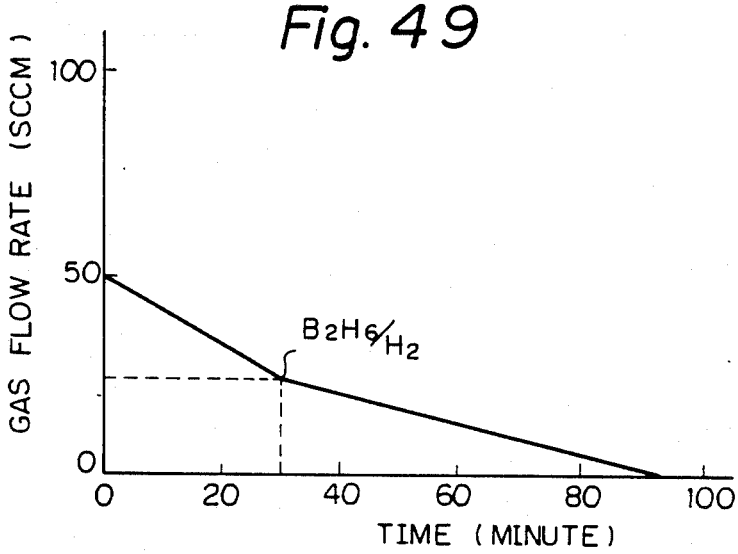

The boron-containing layer was formed by controlling the mass flow controller 2010 for $B_2H_6/H_2$ by means of a computer (HP9845B) so that the flow rate of $B_2H_6/H_2$ might be as shown in FIG. 49.

For these light-receiving members for electrophotography, image exposure was effected by means of the same image exposure device as in Example 33, followed by developing, transfer and fixing, to obtain visible images on plain papers.

The images obtained were free from any interference fringe pattern observed and proved to be satisfactory for practical application.

EXAMPLE 41

Examples 33 to 40 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as in Examples 33 to 40.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

EXAMPLE 42

By means of a lathe, an aluminum substrate (length (L): 357 mm, outer diameter (r): 80 mm) was worked to have the surface characteristic as shwon in FIG. 21 (B).

Next, A-Si type light-receiving members for electrophotography were deposited on the above aluminum substrate following various procedures under the condition No. 101 in Table 1 and the conditions as shown in Table 2F using the deposition device as shown in FIG. 20.

Figure 36:
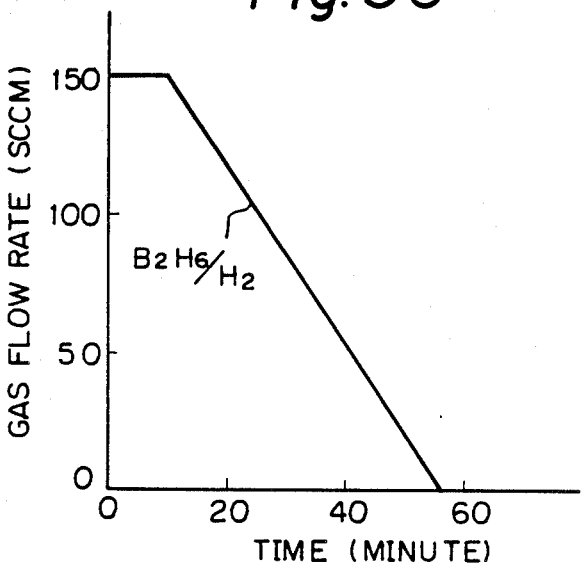

In preparation of the first layer, the mass flow controllers 2007, 2008 and 2010 were controlled by a computer (HP9845B) so that the flow rates of respective gases of $GeH_4$, $SiH_4$ and $B_2H_6/H_2$ might become as shown in FIG. 22 and FIG. 36.

Formation of the surface layer was carried out as follows. After formation of the second layer, the hydrogen ($H_2$) bomb was replaced with argon (Ar) gas bomb, the deposition device cleaned and the material for the surface layer as shown in the condition 101 in Table 1 was placed on the entire surface of the cathode electrode. The above light-receiving layer was set in the device, and the deposition device is brought to reduced pressure sufficiently by means of a diffusion pump. Then, argon gas was introduced to 0.015 Torr and glow discharging excited at a high frequency power of 150 W to sputter the surface layer material, thereby forming the surface layer of the conditions No. 101 in Table 1 on the substrate.

The surface state of the light-receiving member for electrophotography of A-Si:H thus prepared was as shown in FIG. 21 (C).

According to the same method as described above except for forming the surface layer as shown by the conditions 102 to 122 in Table 1, light-receiving members were prepared.

The light-receiving members for electrophotography as prepared above were subjected to image exposure by means of a device as shown in FIG. 26 (wavelength of laser beam: 780 nm, spot diamter 80 μm), followed by development and transfer to obtain images. The images were free from any interference fringe pattern observed and proved to be satisfactory for practical application.

EXAMPLE 43

On cylindrical aluminum substrate having the surface characteristics as shown in FIG. 43, light-receiving members for electrophotography were prepared under the conditions as shown in Table 2F, following otherwise the same procedure as in Example 42.

Figure 37:
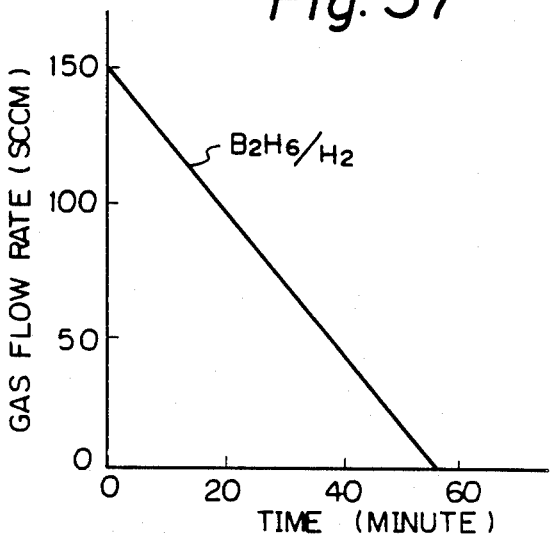

In preparation of the first layer, the mass flow controllers 2007, 2008 and 2010 were controlled by a computer (HP9845B) so that the flow rates of respective gases of $GeH_4$, $SiH_4$ and $B_2H_6/H_2$ might become as shown in FIG. 23 and FIG. 37.

For these light-receiving members for electrophotography, image exposure was effected by means of the same image exposure device as in Example 42, followed by developing, transfer and fixing, to obtain visible images on plain papers.

The images obtained were free from any interference fringe pattern observed and proved to be satisfactory for practical application.

EXAMPLE 44

On cylindrical aluminum substrate having the surface characteristics as shown in FIG. 44, light-receiving members for electrophotography were prepared under the conditions as shown in Table 3F, following otherwise the same procedure as in Example 42.

Figure 38:
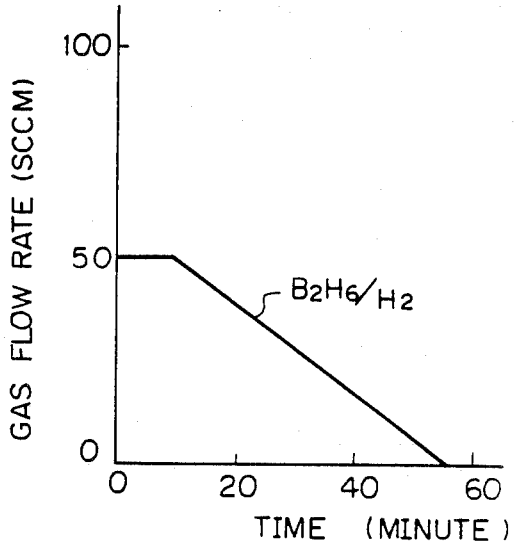

In preparation of the first layer, the mass flow controllers 2007, 2008 and 2010 were controlled by a computer (HP9845B) so that the flow rates of respective gases of $GeH_4$, $SiH_4$ and $B_2H_6/H_2$ might become as shown in FIG. 24 and FIG. 38.

For these light-receiving members for electrophotography, image exposure was effected by means of the same image exposure device as in Example 42, followed by developing, transfer and fixing, to obtain visible images on plain papers.

The images obtained were free from any interference fringe pattern observed and proved to be satisfactory for practical application.

EXAMPLE 45

On cylindrical aluminum substrate having the surface characteristics as shown in FIG. 45, light-receiving members for electrophotography were prepared under the conditions as shown in Table 3F, following otherwise the same procedure as in Example 42.

Figure 39:
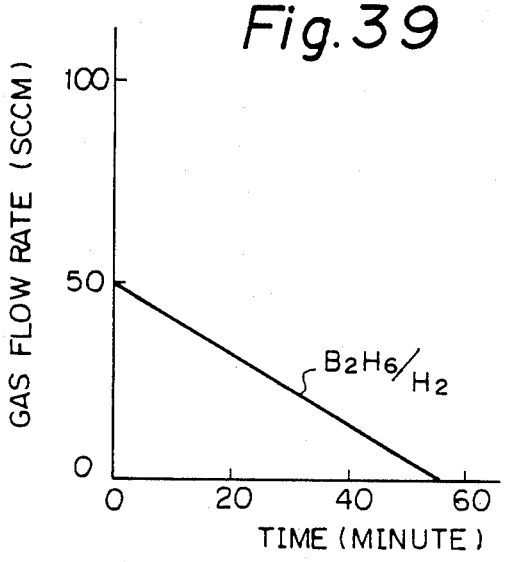

In preparation of the first layer, the mass flow controllers 2007, 2008 and 2010 were controlled by a computer (HP9845B) so that the flow rates of respective gases of $GeH_4$, $SiH_4$ and $B_2H_6/H_2$ might become as shown in FIG. 25 and FIG. 39.

For these light-receiving members for electrophotography, image exposure was effected by means of the same image exposure device as in Example 42, followed by developing, transfer and fixing, to obtain visible images on plain papers.

The images obtained were free from any interference fringe pattern observed and proved to be satisfactory for practical application.

EXAMPLE 46

On cylindrical aluminum substrate having the surface characteristics as shown in FIG. 43, light-receiving members for electrophotography were prepared under the conditions as shown in Table 4F, following otherwise the same procedure as in Example 42.

Figure 40:
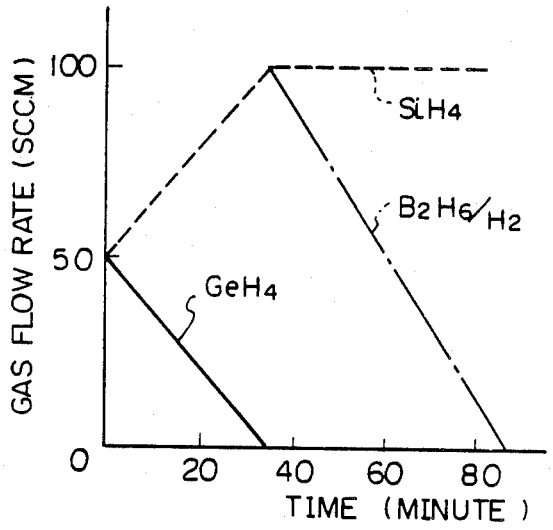

In preparation of the first layer, the mass flow controllers 2007, 2008 and 2010 were controlled by a computer (HP9845B) so that the flow rates of respective gases of $GeH_4$, $SiH_4$ and $B_2H_6/H_2$ might become as shown in FIG. 40.

For these light-receiving members for electrophotography, image exposure was effected by means of the same image exposure device as in Example 42, followed by developing, transfer and fixing, to obtain visible images on plain papers.

The images obtained were free from any interference fringe pattern observed and proved to be satisfactory for practical application.

EXAMPLE 47

On cylindrical aluminum substrate having the surface characteristics as shown in FIG. 44, light-receiving members for electrophotography were prepared under the conditions as shown in Table 5F, following otherwise the same procedure as in Example 41.

Figure 41:
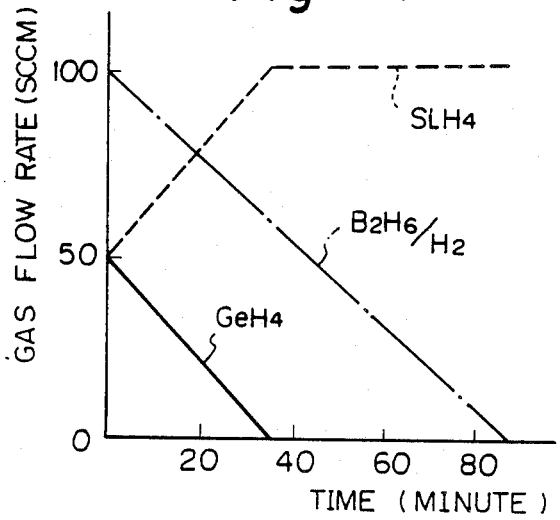

In preparation of the first layer, the mass flow controllers 2007, 2008 and 2010 were controlled by a computer (HP9845B) so that the flow rates of respective gases of $GeH_4$, $SiH_4$ and $B_2H_6/H_2$ might become as shown in FIG. 41.

For these light-receiving members for electrophotography, image exposure was effected by means of the same image exposure device as in Example 42, followed by developing, transfer and fixing, to obtain visible images on plain papers.

The images obtained were free from any interference fringe pattern observed and proved to be satisfactory for practical application.

EXAMPLE 48

On cylindrical aluminum substrate having the surface characteristics as shown in FIG. 45, light-receiving members for electrophotography were prepared under the conditions as shown in Table 6F, following otherwise the same procedure as in Example 42.

Figure 42:
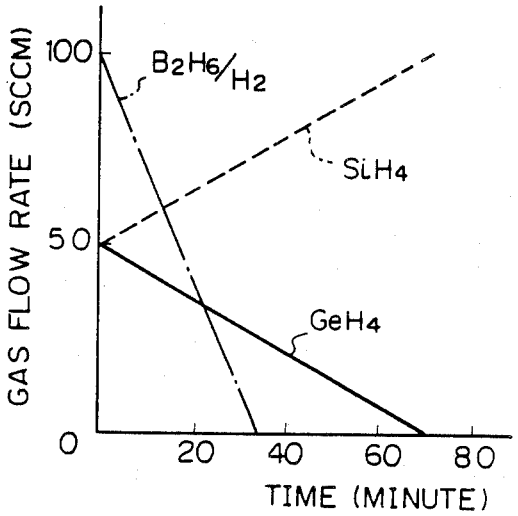

In preparation of the first layer, the mass flow controllers 2007, 2008 and 2010 were controlled by a computer (HP9845B) so that the flow rates of respective gases of $GeH_4$, $SiH_4$ and $B_2H_6/H_2$ might become as shown in FIG. 42.

For these light-receiving members for electrophotography, image exposure was effected by means of the same image exposure device as in Example 42, followed by developing, transfer and fixing, to obtain visible images on plain papers.

The images obtained were free from any interference fringe pattern observed and proved to be satisfactory for practical application.

TABLE 1

| | Condition No. | | | | | | | | | |
|---|---|---|---|---|---|---|---|---|---|---|
| | 101 | 102 | 103 | 104 | 105 | 106 | 107 | 108 | 109 | 110 |
| Material for surface layer | $ZrO_2$ | | $TiO_2$ | | $ZrO_2/TiO_2$ = 6/1 | | $TiO_2/ZrO_2$ = 3/1 | | $CeO_2$ | |
| Refractive index | 2.00 | | 2.26 | | 2.09 | | 2.20 | | 2.23 | |
| Layer thickness (μm) | 0.0975 | 0.293 | 0.0863 | 0.259 | 0.0933 | 0.280 | 0.0886 | 0.266 | 0.0874 | 0.262 |

| | Condition No. | | | | | | | | | | | |
|---|---|---|---|---|---|---|---|---|---|---|---|---|
| | 111 | 112 | 113 | 114 | 115 | 116 | 117 | 118 | 119 | 120 | 121 | 122 |
| Material for surface layer | ZnS | | $Al_2O_3$ | | $CeF_3$ | | $Al_2O_3/ZrO_2$ = 1/1 | | $MgF_2$ | | $SiO_2$ | |
| Refractive index | 2.24 | | 1.63 | | 1.60 | | 1.68 | | 1.38 | | 1.49 | |
| Layer thickness (μm) | 0.0871 | 0.261 | 0.120 | 0.359 | 0.123 | 0.366 | 0.116 | 0.348 | 0.141 | 0.424 | 0.131 | 0.393 |

TABLE 2A

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 50 | | | |
| | $SiH_4$ | 100 | | | |
| Second layer | $H_2$ | 300 | 300 | 24 | 20 |
| | $SiH_4$ | 300 | | | |

TABLE 3A

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 14 | 3 |
| | $GeH_4$ | 100 | | | |
| | $SiH_4$ | 50 | | | |
| Second layer | $H_2$ | 300 | 300 | 24 | 20 |
| | $SiH_4$ | 300 | | | |

TABLE 4A

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| Second layer | $H_2$ | 300 | 300 | 24 | 20 |
| | $SiH_4$ | 300 | | | |

TABLE 5A

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| Second layer | $H_2$ | 300 | 300 | 24 | 20 |
| | $SiH_4$ | 300 | | | |

TABLE 2B

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $100 \rightarrow 0$ | | | |
| | $SiH_4$ | $0 \rightarrow 100$ | | | |
| | | $GeH_4 + SiH_4 = 100$ | | | |
| Second layer | $H_2$ | 300 | 300 | 24 | 20 |
| | $SiH_4$ | 300 | | | |

TABLE 3B

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $50 \rightarrow 0$ | | | |
| | $SiH_4$ | $50 \rightarrow 100$ | | | |
| | | $GeH_4 + SiH_4 = 100$ | | | |
| Second layer | $H_2$ | 300 | 300 | 24 | 20 |
| | $SiH_4$ | 300 | | | |

TABLE 2C

| Layer constitution | Starting gas | Gas flow rate (SCCM) | Discharging power (W) | Deposition rate (A/sec) | Layer thickness (μm) |
|---|---|---|---|---|---|
| First layer | $H_2$ | 300 | 100 | 10 | 3 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 3C

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 50 | | | |
| | $SiH_4$ | 50 | | | |
| | $B_2H_6/H_2$ (= 3000 vol ppm) | 100 | | | |

TABLE 3C-continued

| Layer constitution | | Starting gas | Gas flow rate (SCCM) | Discharging power (W) | Deposition rate (Å/sec) | Layer thickness (μm) |
|---|---|---|---|---|---|---|
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 4C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 50 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 5C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 150 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 6C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 25 | | | |
| | | $SiH_4$ | 75 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 7C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 8C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 9C

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 5 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 10C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 11C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 12C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 13C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 14C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 15C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 2D

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | $50 \rightarrow 0$ | | | |
| | $SiH_4$ | $50 \rightarrow 100$ | | | |
| | $B_2H_6/H_2$ = 3000 ppm | $GeH_4 + SiH_4 = 100$ | | | |
| Second layer | $H_2$ | 300 | 300 | 24 | 20 |
| | $SiH_4$ | 300 | | | |

TABLE 3D

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | $100 \rightarrow 0$ | | | |
| | | $SiH_4$ | $0 \rightarrow 100$ | | | |
| | | $B_2H_6/H_2$ = 3000 ppm | 100 | | | |
| | | | $GeH_4 + SiH_4 = 100$ | | | |
| Second layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 4D

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ = 3000 ppm | 100 | | | |
| | | $GeH_4 + SiH_4 = 100$ | | | |
| Second layer | $H_2$ | 300 | 300 | 24 | 20 |
| | $SiH_4$ | 300 | | | |

TABLE 5D

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ = 3000 ppm | 50 | | | |
| | | | $GeH_4 + SiH_4 = 100$ | | | |
| Second layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 6D

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | | $GeH_4 + SiH_4 = 100$ | | | |
| Second layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 7D

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 1.5 |
| | | $GeH_4$ | 100 → 50 | | | |
| | | $SiH_4$ | 0 → 50 | | | |
| | | $B_2H_6/H_2$ = 3000 ppm | $GeH_4 + SiH_4 = 100$ | | | |
| | Layer B | $H_2$ | 300 | 100 | 10 | 1.5 |
| | | $GeH_4$ | 50 → 0 | | | |
| | | $SiH_4$ | 50 → 100 | | | |
| Second layer | | $H_2$ | 300 | 300 | 24 | 20 |
| | | $SiH_4$ | 300 | | | |

TABLE 2E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 100 | | | |
| | $SiH_4$ | 100 | | | |
| | $B_2H_6/H_2$ = 3000 ppm | $B_2H_6/(GeH_4 + SiH_4)$ = 3/100 → 0 | | | |
| Second layer | $H_2$ | 300 | 300 | 24 | 20 |
| | $SiH_4$ | 300 | | | |

TABLE 3E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 14 | 3 |
| | $GeH_4$ | 50 | | | |
| | $SiH_4$ | 100 | | | |
| | $B_2H_6/H_2$ = 3000 ppm | $B_2H_6$/ | | | |

TABLE 3E-continued

| Layer constitution | Starting gas | Gas flow rate (SCCM) | Discharging power (W) | Deposition rate (Å/sec) | Layer thickness (μm) |
|---|---|---|---|---|---|
| | | $(GeH_4 + SiH_4) = 5/100 \rightarrow 0$ | | | |
| Second layer | $H_2$ | 300 | 300 | 24 | 20 |
| | $SiH_4$ | 300 | | | |

TABLE 4E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 100 | | | |
| | $SiH_4$ | 50 | | | |
| | $B_2H_6/H_2$ = 3000 ppm | $B_2H_6/(GeH_4 + SiH_4) = 1/100 \rightarrow 0$ | | | |
| Second layer | $H_2$ | 300 | 300 | 24 | 20 |
| | $SiH_4$ | 300 | | | |

TABLE 5E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 135 | | | |
| | $SiH_4$ | 15 | | | |
| | $B_2H_6/H_2$ = 3000 ppm | $B_2H_6/(GeH_4 + SiH_4) = 1/100 \rightarrow 0$ | | | |
| Second layer | $H_2$ | 300 | 300 | 24 | 20 |
| | $SiH_4$ | 300 | | | |

TABLE 6E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 2 |
| | $GeH_4$ | 50 | | | |
| | $SiH_4$ | 50 | | | |
| | $B_2H_6/H_2$ = 3000 ppm | $150 \rightarrow 110$ | | | |
| Second layer Layer A | $H_2$ | 300 | 100 | 10 | 3 |
| | $SiH_4$ | 100 | | | |
| | $B_2H_6/H_2$ = 3000 ppm | $110 \rightarrow 0$ | | | |
| Layer B | $H_2$ | 300 | 300 | 24 | 20 |
| | $SiH_4$ | 300 | | | |

TABLE 7E

| Layer constitution | Starting gas | Gas flow rate (SCCM) | Discharging power (W) | Deposition rate (Å/sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| | $B_2H_6/H_2$ = 3000 ppm | $100 \rightarrow 0$ | | | |
| Layer B | $H_2$ | 300 | 100 | 10 | 2 |
| | $GeH_4$ | 50 | | | |
| | $SiH_4$ | 50 | | | |
| | $H_2$ | 300 | | | |
| Second layer | $SiH_4$ | 300 | 300 | 24 | 20 |

TABLE 8E

| Layer constitution | Starting gas | Gas flow rate (SCCM) | Discharging power (W) | Deposition rate (Å/sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |

TABLE 8E-continued

| Layer constitution | | Starting gas | Gas flow rate (SCCM) | Discharging power (W) | Deposition rate (Å/sec) | Layer thickness (μm) |
|---|---|---|---|---|---|---|
| | Layer B | $H_2$ | 300 | 100 | 10 | 2 |
| | | $GeH_4$ | 50 | | | |
| | | $SiH_4$ | 50 | | | |
| | | $B_2H_6/H_2$ = 3000 ppm | 50 → 0 | | | |
| Second layer | | $H_2$ | 300 | 300 | 24 | 20 |
| | | $SiH_4$ | 300 | | | |

TABLE 9E

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ = ppm | 50 → 25 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ = 3000 ppm | 25 → 0 | | | |
| Second layer | | $H_2$ | 300 | 300 | 24 | 20 |
| | | $SiH_4$ | 300 | | | |

TABLE 2F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ = 3000 ppm | $GeH_4 + SiH_4$ = 100 | | | |
| | | 150 → 0 | | | |
| Second layer | $H_2$ | 300 | 300 | 24 | 20 |
| | $SiH_4$ | 300 | | | |

TABLE 3F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | $B_2H_6/H_2$ = 3000 ppm | $GeH_4 + SiH_4$ = 100 | | | |
| | | 50 → 0 | | | |
| Second layer | $H_2$ | 300 | 300 | 24 | 20 |
| | $SiH_4$ | 300 | | | |

TABLE 4F

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| Second layer | Layer A | $H_2$ | 300 | 100 | 10 | 3 |
| | | $SiH_4$ | 100 | | | |
| | | $B_2H_6/H_2$ = 3000 ppm | 100 → 0 | | | |
| | Layer B | $H_2$ | 300 | 300 | 24 | 20 |
| | | $SiH_4$ | 300 | | | |

TABLE 5F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 2 |
| | $GeH_4$ | 50 → 0 | | | |
| | $SiH_4$ | 50 → 100 | | | |

TABLE 5F-continued

| Layer constitution | | Starting gas | Gas flow rate (SCCM) | Discharging power (W) | Deposition rate (Å/sec) | Layer thickness (μm) |
|---|---|---|---|---|---|---|
| | | $B_2H_6/H_2$ = 3000 ppm | 100 → * | | | |
| Second layer | Layer A | $H_2$ | 300 | 100 | 10 | 3 |
| | | $SiH_4$ | 100 | | | |
| | | $B_2H_6/H_2$ = 3000 ppm | * → 0 | | | |
| | Layer B | $H_2$ | 300 | 300 | 24 | 20 |
| | | $SiH_4$ | 300 | | | |

Note:
The symbol * represents continuity of change in the gas flow rate.

TABLE 6F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 → 25 | | | |
| | | $SiH_4$ | 50 → 75 | | | |
| | | $B_2H_6/H_2$ = 3000 ppm | 100 → 0 | | | |
| | Layer B | $H_2$ | 300 | 100 | 10 | 2 |
| | | $GeH_4$ | 25 → 0 | | | |
| | | $SiH_4$ | 75 → 100 | | | |
| Second layer | | $H_2$ | 300 | 300 | 24 | 20 |
| | | $SiH_4$ | 300 | | | |

What we claim is:

1. A light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer of a multi-layer structure having a first layer comprising an amorphous material containing silicon atoms and germanium atoms, a second layer comprising an amorphous material containing silicon atoms and exhibiting photoconductivity and a surface layer having reflection preventive function provided on the substrate successively from the substrate side.

2. An electrophotographic system comprising a light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer of a multi-layer structure having a first layer comprising an amorphous material containing silicon atoms and germanium atoms a second layer comprising an amorphous material containing silicon atoms and exhibiting photoconductivity and a surface layer having reflection preventive function provided on the substrate successively from the substrate side.

3. The invention according to claim 1 or 2, wherein said protruding portions are arranged regularly.

4. The invention according to claim 1 or 2, wherein said protruding portions are arranged in cycles.

5. The invention according to claim 1 or 2, wherein each of said protruding portions has the same shape as the first order approximation.

6. The invention according to claim 1 or 2, wherein said protruding portions have a plurality of subprojections.

7. The invention according to claim 1 or 2, wherein said sectional shape of said protruding portion is symmetrical with the main projection as its center.

8. The invention according to claim 1 or 2, wherein said sectional shape of said protruding portion is asymmetrical with the main projection as its center.

9. The invention according to claim 1 or 2, wherein said protruding portion is formed by mechanical working.

10. The invention according to claim 1 or 2, wherein the distribution state of germanium atoms in the first layer is nonuniform in the layer thickness direction.

11. The invention according to claim 10, the nonuniform distribution state of germanium atoms is more enriched toward the substrate side.

12. The invention according to claim 1 or 2, wherein a substance for controlling conductivity is contained in the first layer.

13. The invention according to claim 12, wherein the substance for controlling conductivity is an atom belonging to the group III or the group V of the periodic table.

14. The invention according to claim 1 or 2, wherein a substance for controlling conductivity is contained in the second layer.

15. The invention according to claim 14, wherein the substance for controlling conductivity is an atom belonging to the group III or the group V of the periodic table.

16. The invention according to claim 1 or 2, wherein the light-receiving layer has a layer region (PN) containing a substance for controlling conductivity.

17. The invention according to claim 16, wherein the distribution state of the substance for controlling conductivity in the layer region (PN) is nonuniform in the layer thickness direction.

18. The invention according to claim 16, wherein the distribution state of the substance for controlling conductivity in the layer region (PN) is uniform in the layer thickness direction.

19. The invention according to claim 16, wherein the substance for controlling conductivity is an atom belonging to the group III or the group V of the periodic table.

20. The invention according to claim 16, wherein the layer region (PN) is provided in the first layer.

21. The invention according to claim 16, wherein the layer region (PN) is provided in the second layer.

22. The invention according to claim 16, wherein the layer region (PN) is provided at the end portion on the substrate side of the light-receiving layer.

23. The invention according to claim 16, wherein the layer region (PN) is provided over both the first layer and the second layer.

24. The invention according to claim 16, wherein the layer region (PN) occupies a layer region in the light-receiving layer.

25. The invention according to claim 24, wherein the content of the substance for controlling conductivity in the layer region (PN) is 0.01 to $5\times10^4$ atomic ppm.

26. The invention according to claim 1 or 2, wherein at least one of hydrogen atoms and halogen atoms are contained in the first layer.

27. The invention according to claim 1 or 2, wherein 0.01 to 40 atomic % of hydrogen atoms are contained in the first layer.

28. The invention according to claim 1 or 2, wherein 0.01 to 40 atomic % of halogen atoms are contained in the first layer.

29. The invention according to claim 1 or 2, wherein 0.01 to 40 atomic % as a total of hydrogen atoms and halogen atoms are contained in the first layer.

30. The invention according to claim 1 or 2, wherein 1 to 40 atomic % of hydrogen atoms are contained in the second layer.

31. The invention according to claim 1 or 2, wherein 1 to 40 atomic % of halogen atoms are contained in the second layer.

32. The invention according to claim 1 or 2, wherein 1 to 40 atomic % as a total of hydrogen atoms and halogen atoms are contained in the second layer.

33. The invention according to claim 1 or 2, wherein at least one of hydrogen atoms and halogen atoms are contained in the second layer.

34. The invention according to claim 1 or 2, wherein the first layer has a layer thickness of 30 Å to 50μ.

35. The invention according to claim 1 or 2, wherein the second layer has a layer thickness of 0.5 to 90μ.

36. The invention according to claim 1 or 2, wherein the light-receiving layer has a layer thickness of 1 to 100μ.

37. The invention according to claim 1 or 2, wherein the layer thickness $T_B$ of the first layer and the layer thickness T of the second layer satisfy the relationship of $T_B/T \leqq 1$.

38. An electrophotographic image forming process comprising:

(a) applying a charging treatment to the light receiving member of claim 1;

(b) irradiating the light receiving member with a laser beam carrying information to form an electrostatic latent image; and (c) developing said electrostatic latent image.

* * * * *

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below: On the Title Page:

AT [56] IN THE REFERENCES

Foreign Patents, "56-50754 11/1981 Japan ..... 430/65" should read --56-150754 11/1981 Japan .....430/65--.

COLUMN 1

Line 13, "741,300;" should be deleted.
Line 49, "layer,for" should read --layer, for--.
Line 49, "$10_{12}$" should read --$10^{12}$--.

COLUMN 2

Line 9, "easiness" should read --ease--.
Line 17, "an" should read --a--.
Line 28, "iamge." should read --image.--.
Line 42, "layeris" should read --layer is--.

COLUMN 3

Line 14, "sized" should read --sizes--.
Line 24, "sufficinent" should read --sufficient--.
Line 48, "R1" should read --$R_1$--.
Line 60, "may be" should read --is--.
Line 61, "tne" should read --the--.
Line 62, "tne" should read --the--.

COLUMN 4

Line 5, "so much" should read --greatly--.
Line 38, "interferance" should read --interference--.

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below:

COLUMN 5

Line 31, "schemat;c" should read --schematic--.
Line 35, "illustration" should read --illustrations--.
Line 42, "layer;" should read --layers;--.
Line 52, "45" should read --45 are--.
Line 67, "accompnaying" should read --accompanying--.

COLUMN 6

Line 22, "interrerence" should read --interference--.
Line 33, "($d_7 \neq d_8$), "should read --($d_7 \neq d_8$)--.
Line 49, "difraction" should read --diffraction--.
Line 67, "$l < L$," should read --$l \leq L$--.

COLUMN 7

Line 9, "$d_5 - d_6 > \lambda/2n$" should read --$d_5 - d_6 \geq \lambda/2n$--.
Line 43, "bite" should read --bit.
Line 45, "5" should be deleted.

COLUMN 8

Line 13, "in" should be deleted.
Line 48, "more" should be deleted.
Line 49, "is" should read --in--.
Line 58, "0.3 μm," should read --0.3 μm to 3 μm,--.
Line 66, "an uniformness" should read --uniformity--.

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below:

COLUMN 9

Line 24, "considerations." should read --considerations,--.
Line 32, "inorganic.nitrides" should read --inorganic nitrides--.
Line 41, "method." should read --method,--.
Line 67, "the all" should read --all the--.

COLUMN 10

Line 4, "the" should read --to the--.
Line 19, "A-SiGe(H,X)," should read --A-SiGe(H,X)),--.
Line 57, "as hereinafter," should read --hereinafter,--.
Line 59, "great," should read --greatly,--.

COLUMN 11

Line 36, "In case" should read --In the case--.
Line 44, "In case" should read --In the case--.

COLUMN 13

Line 8, "30Åto" should read --30 Å to--.
Line 9, "40Åto" should read --40 Å to--.
Line 9, "50Åto" should read --50 Å to--.
Line 27, "$T_B/T < 1$" should read --$T_B/T \leq 1$--.
Line 31, "$T_B/T < 0.9$," should read --$T_B/T \leq 0.9$,--.
Line 31, "$T_B/T < 0.8$," should read --$T_B/T \leq 0.8$,--.
Line 42, "bormine" should read --bromine--.

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below:

COLUMN 14

Line 2, "atpms" should read --atoms--.
Line 9, "easiness" should read --ease--.
Line 17, "easiness" should read --ease--.
Line 38, "so called" should read --so-called--.
Line 68, "ion plating "should read --ion-plating--.

COLUMN 16

Line 14, "a-Si(H,X)" should read --A-Si(H,X)--.

COLUMN 17

Line 7, "depending on" should be deleted.
Line 37, "so called" should read --so-called--.
Line 40, "condutivity" should read --conductivity--.
Line 55, "suitably be" should read --suitably--.

COLUMN 18

Line 13, "+" should read --⊕--.
Line 48, "so called" should read --so-called--.
Lines 53-54 "so called" should read --so-called--.
Line 66, "$(1 < i < 9)$ or Ci $(1 < i < 17)$" should read --$(1 \leq i \leq 9)$ or Ci $(1 \leq i \leq 17)$--.

COLUMN 19

Line 48, "the $t_4$" should read --the position $t_4$--.

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below:

COLUMN 20

Line 56, "Typical" should read --As typical--.

COLUMN 21

Line 55, "apply" should read --image--.
Line 62, "device fixing" should read --device, fixing--.

COLUMN 22

Line 24, "cylindirical" should read --cylindrical-.
Line 28, "2008 2010" should read --2008, 2010--.
Line 30, "prcssure" should read --pressure--.
Line 33, "respectivcly" should read --respectively--.
Line 53, "$B_2H_6$" should read --$B_2H_6/H_2$--.

COLUMN 23

Lines 10-11, devide," should read --device,--.
Line 25, "outerdiameter" should read --outer diameter--.
Line 40, "is" should read --was--.

COLUMN 24

Line 42, "outerdiameter" should read --outer diameter--.
Line 62, "is" should read --was--.

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below:

COLUMN 26

Line 15, "outerdiameter" should read --outer diameter--.
Line 30, "is" should read --was--.
Line 38, "surfacc" should read --surface--.

COLUMN 30

Line 9, "outerdiameter" should read --outer diameter--.
Line 58, "conditions" should read --procedure--.

COLUMN 31

Line 10, "conditions" should read --procedure--.
Line 50, "conditions" should read --procedure--.

COLUMN 32

Line 2, "conditions" should read --procedure--.
Line 22, "conditions" should read --procedure--.
Line 42, "conditions" should read --procedure--.

COLUMN 33

Line 6, "outerdiameter" should read --outer diameter--.
Line 21, "is" should read --was--.
Line 26, "No 101" should read --No. 101--.
Lines 49-50, "electro photography," should read --electrophotography--.

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below:

COLUMN 35

Line 48, "shwon" should read --shown--.
Line 67, "is" should read --was--.

COLUMN 39

Table 2C, "Deposition rate (Å/Sec)" should read --Deposition rate (Å/Sec)--.

COLUMNS 49-50

Table 7E,

| | | | | | |
|---|---|---|---|---|---|
| " | $H_2$ | 300 | | | " |
| Second layer | $SiH_4$ | 300 | 300 | 24 | 20 |

should read

| | | | | | |
|---|---|---|---|---|---|
| --Second layer | $H_2$ | 300 | 300 | 24 | 20-- |
| | $SiH_4$ | 300 | | | |

COLUMN 51

Table 9E, "$B_2H_6/H_2$ = ppm" should read --$B_2H_6$ = 3000ppm--.

COLUMN 53

Line 51, "atoms a" should read --atoms, a--.

UNITED STATES PATENT AND TRADEMARK OFFICE

CERTIFICATE OF CORRECTION

PATENT NO. : 4,705,735

DATED : November 10, 1987

INVENTOR(S) : KEISHI SAITOH, ET AL.

It is certified that error appears in the above-identified patent and that said Letters Patent is hereby corrected as shown below:

COLUMN 54

Line 37, "10, the" should read --10, wherein the--.

Signed and Sealed this

Eleventh Day of October, 1988

*Attest:*

*Attesting Officer*

DONALD J. QUIGG

*Commissioner of Patents and Trademarks*